United States Patent [19]

Meyer et al.

[11] Patent Number: 4,787,915

[45] Date of Patent: Nov. 29, 1988

[54] METHOD OF VARYING RHEOLOGY CHARACTERISTICS OF NOVEL COAL DERIVED FUEL SYSTEM

[75] Inventors: Edmond G. Meyer, Laramie, Wyo.; Lee G. Meyer; Gerald F. Cavaliere, both of Englewood, Colo.

[73] Assignee: Carbon Fuels Corporation, Englewood, Colo.

[21] Appl. No.: 84,270

[22] Filed: Aug. 11, 1987

Related U.S. Application Data

[63] Continuation-in-part of Ser. No. 59,288, Jun. 8, 1987, which is a continuation-in-part of Ser. No. 722,689, Apr. 12, 1985, abandoned, which is a continuation-in-part of Ser. No. 658,880, Oct. 9, 1984, Pat. No. 4,658,936, and Ser. No. 658,878, Oct. 9, 1984, Pat. No. 4,671,800, said Ser. No. 658,880, and Ser. No. 658,878, is a continuation-in-part of Ser. No. 427,937, Sep. 29, 1982, Pat. No. 4,475,924, which is a continuation-in-part of Ser. No. 247,382, Mar. 24, 1981, abandoned.

[51] Int. Cl.[4] ..... C10L 1/32

[52] U.S. Cl. ..... 44/51; 44/607; 44/620

[58] Field of Search ..... 44/1 SR, 51, 607, 620

[56] References Cited

U.S. PATENT DOCUMENTS

| | | | |
|---|---|---|---|
| 4,460,378 | 7/1984 | Di Pietro et al. | 44/53 |
| 4,475,924 | 10/1984 | Meyer | 44/51 |
| 4,671,800 | 6/1987 | Meyer et al. | 44/51 |
| 4,685,936 | 8/1987 | Meyer et al. | 44/51 |

*Primary Examiner*—Jacqueline V. Howard
*Attorney, Agent, or Firm*—Lee G. Meyer

[57] ABSTRACT

The rheology of a fluidic, substantially combustible non-polluting liquid/solid slurried fuel system derived in substantial part from hydrodisproportionation of coal is varied by addition of fluidic aqueous mixtures and lower chain alcohols to alter the rheology of the mixture and reduce the thermal $NO_x$ upon combustion.

27 Claims, 1 Drawing Sheet

METHOD OF VARYING RHEOLOGY CHARACTERISTICS OF NOVEL COAL DERIVED FUEL SYSTEM

TECHNICAL FIELD

This application is a continuation-in-part of U.S. patent application Ser. No. 059,288 filed June 8, 1987, which is a continuation-in-part of U.S. patent application Ser. No. 722,689, filed Apr. 12, 1985 now abandoned which is a continuation-in-part of, U.S. patent application Ser. No. 658,880, filed Oct. 9, 1984, now U.S. Pat. No. 4,658,936 and U.S. patent application Ser. No. 658,878, also filed Oct. 9, 1984, now U.S. Pat. No. 4,671,800, issued June 9, 1987, both of which are continuations-in-part of U.S. patent application Ser. No. 427,937, filed Sept. 29, 1982, now U.S. Pat. No. 4,475,924, issued Oct. 9, 1984, which is a continuation-in-part of U.S. patent application Ser. No. 247,382, filed Mar, 24, 1981, now abandoned.

The parent applications, which are incorporated in their entirety by reference as if they were completely set out herein, disclose a transportable fuel system as well as non-polluting, fluidic, completely combustible, transportable fuel compositions derived from coal, which compositions contain particulate coal char admixed with liquids obtained from pyrolysis of coal and methods for making such a system and fuel compositions. The parent applications further disclose that the pyrolysis method can be altered to vary the product and co-product distribution as well as the rheological characteristics of the fuel system. The parents also disclose that the method of pyrolysis of the coal, and specifically hydropyrolysis, is important in determining both the economics of the process and the product.

The instant invention generally relates to volatilization of coal to produce char and liquid co-products without utilization of external hydrogen, ie., hydrogen other than that contained in the coal feedstock, and more particularly to an improved method of economically producing uniform, fluidic, oil-type transportable fuel systems and fuel compositions and a slate of "value-added" co-products by a coal refining process employing hydrodisproportionation.

The fuel systems comprise a char/process oil slurry which is completely derived from coal. They contain particulate coal char derived from solid carbonaceous fuels such as coal, lignite, lower rank coals, waste coals, peat and the like admixed with hydrocarbon liquids derived during the volatilization process and/or with alcohols, which can also be derived as co-products of the process, to form an oil-type transportable, fluidic fuel slurry. These fluidic fuel systems are substantially non-polluting and substantially completely combustible as compared to, for example, coal/water slurries. The fuel system and the process for making same represent precombustion clean coal technology.

More particularly, this invention relates to an economical method of preparing high energy, non-polluting, transportable fluidic fuel systems, and a slate of co-products by a novel hydrodisproportionation process. This method of producing the fluidic fuel system and the co-products, which are derived solely from coal feedstock, is accomplished without the use of external hydrogen; maximizes the production of high quality co-products such as BTX, naphtha and methanol; cleans up the pollution causing material in the coal; and enables the tailoring of the rheology characteristics to fit a specific transportation means as well as altering the slurry composition to a particular end-use application.

More particularly, the instant invention relates to an improved method of varying the rheology characteristics of fluidic transportable fuel systems and fuel compositions by additions of amounts of fluidic aqueous materials effective to enhance pumpability. The fuel systems are combustible and contain particulate coal char derived from solid carbonaceous fuels such as coal, lignite and lower rank coals, and the like. More particularly, this invention relates to a method of preparing high energy, non-polluting, transportable fluidic fuel systems, which are derived substantially from coal, wherein the slurry can be followed to specific transportation means as well as to particular end-use applications by use of fluidic aqueous mixtures which vary the rheological characteristics and act as a medium for hydrophyllic surfactants and suspension agents.

BACKGROUND ART

Coal is America's (and the world's) most abundant fossil fuel. The proven U.S. reserves of coal (in terms of energy content) are over 15 times greater than its reserves of oil and gas combined. This means that in excess of 80% of the U.S. fossil fuel supply (including oil shale) is in the form of coal. However, coal has three major drawbacks. (1) Coal is a solid and is less easily handled and transported than fluidic or gaseous materials. (2) Coal contains compounds which, on burning, produce the pollutants associated with acid rain. (3) Coal is not a uniform fuel product, varying in characteristics from region to region and from mine to mine.

In fossil fuels, the ratio of hydrogen atoms to carbon atoms is most important in determining the heating value per unit weight. The higher the hydrogen content, the more liquid (or gaseous) the fuel, and the greater its heat value. Natural gas, or methane, has a hydrogen-to-carbon ratio of 4 to 1 (this is the maximum); coal has a ratio of about 1 to 1; shale oil about 1.5 to 1; petroleum crude about 2.0 to 1; and gasoline almost 2.2 to 1.

Liquefaction of coal involves hydrogenation. If the coal has a hydrogen-to-carbon ratio of 1, and if the hydrogens on half the carbons could be transferred or "rearranged" to the other half of the carbons, then the result would be half the carbons with 0 hydrogens and half with 2 hydrogens. The first portion of carbons (with 0 hydrogens) is char; the second portion of carbons (with 2 hydrogens) is a liquid product similar to a petroleum fuel oil. If this could be accomplished using only hydrogen inherent in the coal, ie., no external hydrogen source, then the coal could be refined in the same economical manner as petroleum, yielding a slate of refined hydrocarbon products and char.

Transportation

One very effective use of our coal resource is in stationary boilers producing electricity or process heat. Stationary power conversion facilities can operate using fuels other than the more expensive, less abundant liquid and gaseous hydrocarbons, freeing these high performance gas and oil fuels for transportation and residential/commercial uses. The use of coal in stationary power facilities, however, requires that either the solid coal be transported to the power facility, adding to the cost of the fuel, or the power plant be constructed at the mine site for "mine mouth" utilization of the coal. Producing electricity at the mine site is not always efficient becuase of possible water scarcity, environmental problems, and electrical transmission losses.

Coal is currently shipped by rail. The required handling of coal as a solid fuel is cumbersome, wasteful and expensive. The inefficient and expensive handling, transportation and storage of the solid material makes the conversion of oil-fired systems to coal less economically attractive and causes coal not to be economically exportable. The majority of the energy transportation and combustion systems in this country revolve around oil and natural gas which are relatively uniform, pipeline transportable liquid and gaseous fuels. Liquids are much more easily handled, transported, stored and fired into boilers. Because of this nation's dependence on domestically produced oil and natural gas, domestic fuel transportation systems, from pipelines to ocean-going tankers, are designed for liquids and gases.

Uniformity

Coal transportation problems are compounded by the fact that, although coal reserves are distributed throughout the U.S., coal from different reserves has a wide range of characteristics. It is not a uniform fuel of consistent quality. For example, intermountain western coal, while low in sulfur, is also generally low in BTU per unit weight and has a high water content. In contrast, most coals from the eastern U.S. are high in Btu content but so high in sulfur as to be out of compliance with federal air quality standards. Because coal does not burn uniformly, its combustion produces (thermal) $NO_x$ pollutants. Further, coals, even of the same rank and from the same mine, have different compositions. Coal from one region (or even of a particular mine) cannot be efficiently combusted in boilers designed for coal from another source. The limitation in the interchangeability of coal in combustion systems reduces markets. Boilers and pollution control equipment must either be tailored to a specific coal or configured to burn a wide variety of material with a loss in efficiency. Therefore, coal is not as uniform or desirable a fuel as is, for example, #6 fuel oil.

Pollution

The non-uniformity and transportation problems are compounded by combustion pollutants inherent in coal. Coal is not a refined product like No. 6 fuel oil; rather, it is a raw material like crude oil. Raw coal cleaning is available but cannot remove the nitrogen and organic sulfur compounds which, upon combustion, produce $SO_x$ and $NO_x$ pollutants-"acid rain". Further, as indicated above, the non-uniformity of coal leads to thermal $NO_x$ pollutants. Heretofore fluidized bed boilers, which require limestone as an $SO_x$ reactant, and scrubbers or catalytic convertors, socalled combustion, and post-combustion clean air technologies, have been proposed to alleviate these pollution problems. These devices clean the combustion and flue gas rather than the fuel and are tremendously expensive from both capital and operating standpoints, adding to the cost of power. This adds to the cost of domestically produced goods, ultimately diminishing this nation's competitiveness with foreign goods.

Synfuels

Various methods, which for the most part are not economically viable, have been proposed for converting coal to synthetic liquid or gaseous fuels. While these "synfuels" are more easily transported than coal, the conversion processes are capital intensive; require a great deal of water and external hydrogen, ie., hydrogen provided from other than the coal feedstock; and are very expensive. The processes are also energy intensive in that essentially most carbon atoms in the coal matrix are converted to hydrocarbons. This differs markedly from merely "rearranging" existing hydrogen in the coal molecule. While the resultant synfuel, like fuels derive from crude oil, is valuable as a transportation fuel, synfuels have not, to date, been an economical solution to the problems associated with coal.

Pyrolysis

As previously disclosed, coal pyrolysis is a well known process whereby coal is thermally volatilized by heating the coal out of contact with air. Different pyrolysis products may be produced by varying the conditions of temperature, pressure, atmosphere and/or material feed.

A particular type of coal pyrolysis, hydropyrolysis, is characterized by pyrolysis of the coal in the presence of a reactor atmosphere which has a hydrogen partial pressure greater than that produced by the heated coal. In most hydropyrolysis processes, the additional hydrogen is externally generated, which substantially increases the processing cost.

Hydropyrolysis of coal to produce char and pyrolysis liquids and gases from bituminous and subbituminous coals of various ranks is well known in the art. In such processes, coal is heated in the presence of hydrogen or a hydrogen donating material to produce a carbonaceous component called char and various hydrocarbon-containing oil and gas components. A particular type of coal hydropyrolysis, flash hydropyrolysis, is characterized by a very short reactor residence time of the coal. Short residence time (SRT) processes are advantageous in that the capital costs are reduced because the feedstock throughput is so high. In SRT processes, high heating rates are required to effect the transformation of coal to char, liquids and gases. In many processes, hydrogen is oxydized to gain the high quality heat. However, the oxidation of hydrogen not only creates water but also reduces the hydrogen available to hydrogenate hydrocarbons to higher quality fuels. Thus, in prior art processes, either external hydrogen is required or the product is derated because valuable hydrogen is converted to water.

The economic feasibility of producing the fluidic fuel is predicated on the method of volatilizing the coal to produce the slurry and a slate of value-added co-products. The economics of transporting the fluidic slurry fuel are predicated upon the slurry's rheology.

Slurries

Methods for creating coal slurries or mixtures which facilitate liquid transport and fluidic firing into boiler systems have been proposed but have not been completely successful. The best known of these systems is the coal/water slurry produced when raw coal is ground, sized, slurried with water, and stabilized. Coal slurries are comprised of ground coal particles which have jagged, nonsymmetrical shapes due to fracturing along crystal faces. This configuration not only is abrasive to conduit systems but also adversely affects the loading limits and flow characteristics of the slurry system. Since coal is the main fuel constituent in such slurries, furnace and stack modifications are still required in order to burn coals from different regions. Expensive pollution abatement and reduction equipment is still required.

Coal slurries require special pipelines and pumping equipment and have not generally been transportable by rail. Aqueous coal slurries have additional drawbacks: (1) the water which is necessary to slurry coal is in short supply for coal reserves in the intermountain west; (2) water must be removed from the slurry and the coal must be dried prior to introduction of the fuel into a furnace or boiler to avoid incurring a substantial heat penalty, i.e. derating of the boiler; (3) dewatering and disposal of the slurry water creates a pollution problem since many of the pollutants in the coal are dissolved in the water; and (4) coal slurries tend to settle upon standing, thereby causing flow problems in pipelines tanker cars and ballast problems aboard ships.

Liquids other than water, such as alcohol, may be used as the slurrying liquid for coal but are expensive and usually require water for manufacture. Non-aqueous liquids used for slurrying (including alcohol) tend to solubilize impurities in the coal to an even greater extent than does water.

While coal/water slurries and coal/alcohol slurries require system modification in order to be fired in existing oil-fired combustion systems, coal/oil mixtures ("COM") are able to be burned in existing coal-fired furnaces, boilers and process heat generators without substantial equipment modification other than soot handling equipment. COMs, which comprise a pulverized, comminuted or ground coal admixed with oil, may contain various additives to, for example, increase the wetability of the coal, stabilize the mixture, etc. COMs, while having a higher BTU content per unit volume than coal alone, have serious drawbacks. First, the oil used as the slurry medium draws from the U.S. domestic or foreign supply of crude oil; therefore, it only partially cuts down on this country's foreign oil dependence. Second, there are several restrictions on the export of oil even as a component of a coal/oil mixture; thus there is a limited foreign market. Third, crude oil is expensive and, wwith the additional slurrying expense, the cost savings to an oil-fired system are marginal. Finally, because unrefined coal is a major component of the slurry, these COMs have all the previously enumerated inherent drawbacks of coal and of other coal-containing slurries.

Another slurry system involves the use of coke with the volatiles liberated during the coking process (U.S. Pat. No. 4,208,251, issued June 17, 1980 to Rasmussen). In this process, coal is heated in accordance with known methods, producing a "coked" product which is then admixed with some of the liquefied, liberated volatile materials produced during coking. These liquefied products are viscous tars which do not "flow" in oil pipelines. Coke is generally too large (20 to 80 millimeters) to be readily utilized in oil fired combustion systems without extremely difficult and expensive system modification. Coke is an agglomerated product of substantially low reactivity, high pore diameter, and low surface area, which characteristics reduce its effectiveness as a fuel and increase the combustion $NO_x$. Although coke's substantially cubical shape is effective as a structural strata in blast furnace operations, it greatly impedes the "pumpability" of the coke-containing slurry. The slurry product cannot be transported economically, is not conducive to oil pipeline transport, and is not readily combustible in existing boiler systems.

Rheology

Rheology is the study of the deformation and flow of matter, primarily of the mechanics of deformable liquids or solids. The study of rheology is complicated by nonideal behavior. A liquid whose viscosity decreases with increasing stress (such as increased rate of flow or of stirring) is called pseudoplastic; if the viscosity increases with the stress, the liquid is dilatant.

The measured viscosity of a system is given by a ratio as a function of shear. A Newtonian fluid is one whose viscosity coefficient is independent of shear. Non-Newtonian liquids have viscosities that are dependent on the rate of shear. The situation becomes considerably more complicated since the measured viscosity can vary with time as well as with shearing stress. A liquid which becomes more fluid with increasing time of flow is said to be thixotropic, while if the opposite is true, the liquid is said to exhibit rheopexy.

As set forth in the parent applications, the feasibility of economically producing and transporting a coal derived fluidic slurry fuel is predicated upon its method of manufacture. Also as disclosed in the parent applications, the instant novel fuel system exhibits some very advantageous rheology properties and, more importantly, the means for varying these rheology chracteristics for end-use application or a particular pumping system. In many cases, the fuel system is pseudoplastic and even thixotropic. This allows storage of the slurry which is readily pumpable. These rheology characteristics are a function of the characteristics of the liquid, including its viscosity, as well as of the characteristics of the solid, including its shape, and the interaction of stabilizers. It will be realized that the rheology of any given slurry admixture is highly empirical. However, the instant invention is concerned with efficient and economical methods of manufacture which can be used to vary the rheology of the slurry in order to tailor the fuel system to specific transport systems as well as end-use applications, while simultaneously producing a slate of desirable "value-added" co-products.

Methanol Synthesis

The prior art methods of producing methanol directly from coal are expensive and water intensive. Applicants' U.S. Pat. No. 4,475,924 contemplates using alcohols or mixtures of alcohols and process oil as the liquid slurry medium for applicants' novel fuel system. In accordance with the known process for making methanol directly from coal and steam, carbon monoxide and hydrogen are initially formed in accordance with equation I:

$$\text{HOH (steam)} + \text{C (coal)} \rightarrow \text{CO} + \text{H}_2. \qquad \text{I.}$$

A portion of the gas is subjected to the shift reaction with steam to produce additional hydrogen in accordance with equation II:

$$\text{CO} + \text{HOH (steam)} \rightleftarrows \text{CO}_2 + \text{H}_2. \qquad \text{II.}$$

The $CO_2$ is scrubbed from the gaseous product leaving primarily hydrogen. The hydrogen is admixed with gaseous products of equation I to produce a gas having a desired ratio of hydrogen to carbon monoxide from which methanol and similar products are synthesized catalytically.

In the methanol synthesis plant, the respective constituents, such as carbon monoxide and hydrogen, are combined to produce methanol. These constituents have heretofore only been economically available from natural gas. The synthesis of methanol is described in pages 370–398 of vol. 13 of the KIRK-OTHMER ENCYCLOPEDIA OF CHEMICAL TECHNOLOGY, second edition, Anthony Standin, editor, Interscience Publishers, New York, 1969, vol. 5. The carbon monoxide and hydrogen are controlled in a ratio and temperature pressure combination to obtain maximum yields of the methanol fuel product. Other methods for methanol synthesis at lower temperatures and pressures are also known, as, for example, the ICI low pressure process described in "Here's How ICI Synthesizes Methanol at Low Pressure", Oil and Gas Journal, vol. 66, pp. 106–9, Feb. 12, 1968. The problem with these prior art methods is that the production of the starting materials, ie., CO and $H_2$, from coal was very expensive.

Methanol, in addition to being a diluent used to alter the rheology of the fluidic fuel, is also useful as an oxygenated motor vehicle fuel. Methanol, when combined with ethanol and/or gasoline, creates a clean burning, motor vehicle fuel. This is important in this nation's campaign against pollution. Therefore, an inexpensive method of production of methanol from coal would be advantageous.

Low Rank and Waste Coals

The lignites, peats, and lower calorific value subbituminous coals have not had an economic use except in the vicinity of the mine site, ie., mine mouth power generation facilities. This is due primarily to the cost of shipping a lower Btu product as well as to the danger of spontaneous combustion because of the high content of volatile matter and high percentage of moisture which is characteristic of such coals. Utilization at the mine site to produce electricity is not always efficient due to transmission and/or conversion losses. A further attendant problem with the use of low Btu solid fuels generally, and lignites especially, is that they do not contain the same mixtures of constituents, thus requiring specific boiler design to burn material from a particular deposit.

Since low rank coals contain high percentages of volatile matter, they retain the risk of spontaneous combustion after dehydration, even by the nonevaporation method.

Therefore, in order to secure stability of the dehydrated coal in storage and transportation, it has been necessary to cover the coal with an atmosphere of inert gas such as nitrogen or combustion product gas, or to coat it with crude oil so as not to reduce its efficiency as a fuel. However, the use of an inert gas is not economical because of its production energy requirement. The method of coating the dehydrated coal with crude oil has proven effective in preventing both spontaneous combustion and the creation of coal dust during transportation. Heretofore this method has also been uneconomical because the crude oil must be purchased and transported to the dehydration facility.

Waste coal has somewhat different inherent problems from those of the low rank coals. Waste coal is sometimes referred to as "non-compliance coal" because it is too high in sulfur per unit heat value to burn in compliance with the EPA standards. Other waste coal is too low in Btu to be transported economically. This coal represents not only an environmental problem (because it must be buried or otherwise disposed of), but also is very economically unattractive. It must be mined in order to reach the marketable coal.

Pollution from Coal

As set forth previously, coal has inherent material which, upon combustion, creates pollutants which are thought to cause acid rain; specifically, sulfur compounds and nitrogen compounds. The sulfur compounds are of two types, organic and inorganic (pyritic). Prior art coal cleaning processes could only reach the inorganic material. Further, because of the nonuniformity of coal it combusts with "hot spots". Some of the nitrogen in the combustive air (75% nitrogen by weight) is oxidized to produce $NO_x$ as a result of the temperature created by these "hot spots". This so-called thermal $NO_x$ has heretofore only been reduced by expensive boiler systems. It would, therefore, be advantageous to clean up the coal by removing the organic nitrogen (fuel nitrogen) as well as the organic sulfur (fuel sulfur) while providing a uniform fuel with high reactivity and lower flame temperature to reduce the thermal $NO_x$.

In short, the U.S. energy scene has focused on a number of individual solutions to a many-faceted problem. A fuel "systems" approach is necessary to fully utilize the nation's substantial coal reserves. It would be highly advantageous to have a completely combustible fluidic fuel system which is easily and efficiently prepared from coal using no external water and which would be (a) transportable using existing pipeline, tanker car and tankership systems, (b) burnable either directly as a substitute for oil in existing oil-fired combustion systems with little or no equipment modification, or separable at the destination to provide a liquid hydrocarbon fuel or feedstock and a burnable char, (c) a uniform combustion product regardless of the region from which the coal is obtained, (d) high in BTU content per unit weight and volume, (e) low in ash, sulfur and nitrogen, (f) high in solid loading and stability and (g) free of polluting effluents which would have to be disposed of at the production site or at the destination.

SUMMARY OF THE INVENTION

The grandparent to the instant application, U.S. Pat. No. 4,475,924, issued Oct. 9, 1984, describes such a system. One of the parents to this application, U.S. patent application Ser. No. 658,880, describes improvements in process technologies and slurry components to improve rheology. The other parent, of which Ser. No. 658,880 is also a parent, describes utilization of water as an emulsification agent and alcohols to vary rheology. Patent application Ser. No. 658,878, now U.S. Pat. No. 4,671,800, issued June 9, 1987, discloses use of waste coals, lower rank coals and peat as feedstocks for the novel fuel systems. The instant invention relates to an improved method for providing the fluidic fuel system by a novel method for refining coal. This process more economically produces a fuel system allowing substantially all the solid to be slurried with desirable rheology characteristics. The novel process also produces a valuable slate of co-products.

It has been discovered that, by varying the process parameters during pyrolysis and/or treating the solids and liquids subsequent to the pyrolysis, and/or adding aqueous mixtures, not only can the rheology of the slurry be tailored to specific transportation systems but coals which produce larger percentages of more valuable hydrocarbon liquids and/or tars can be slurried.

The instant process overcomes prior art disadvantages by economically converting coal into a novel fluidic fuel which may be transported in existing oil pipelines; has substantially reduced sulfur and nitrogen content; is a uniform fuel, thus reducing thermal $NO_x$; and has a very high heat value, preferably in the range of from about 12,000 to 15,000 Btu/lb.; contains an emulsifying amount of water to enhance rheology and burn characteristics; contains methanol which is a diluent as well as a flame temperature reducer to inhibit the formation of thermal $NO_x$ and enhance rheology characteristics. Thus, the process enhances the value and utility of coal, lignite, peats, as well as low rank and waste coal, and also makes possible the profitable shipment of U.S. refined coal products throughout the United States and to many foreign nations by means of petroleum type transport and handling.

In accordance with the instant invention, coal is economically refined to produce a clean, fluidic, pipeline transportable fuel system and a slate of valuable co-products by internal hydrogen transfer and rearrangement or hydrodisproportionation in a cascading "step down" process. Hydrodisproportionation is accomplished by volatilizing coal in the absence of oxygen and in the presence of internally-generated hydrogen to transfer and rearrange internal hydrogen. The "step down" process conserves energy by negating the necessity of reheating the products to separate various constituents. This process enhances rheological characteristics by producing lighter material and an inexpensive methanol co-product.

Specifically, the instant invention involves refining of coal by short residence time hydrodisproportionation (SRT-HDP). The inventive process, which is from 75% to 85% energy efficient (as opposed to 35% to 50% efficiency for synfuels), uses carbonaceous material as the sole feedstock. The process results in compliance products with few, if any, of the sulfur and/or nitrogen components which cause combustion pollutants.

More specifically, the instant invention employs the heating of pre-conditioned coal in the presence of internally produced hydrogen rich reducing atmosphere, to effect a "flash" volatilization to separate the solid char particles from the gases and liquids. The hot liquids are "stepped down" in a separation/hydrotreating process to produce the co-products (BTX, naphtha, elemental sulfur, ammonia and hydrocarbon liquids which are components of the fluidic fuel system) while the gas is used to efficiently produce methanol as well as to provide internally generated hydrogen.

In accordance with one aspect, there is no recycle stream of reactants (except for purified gas), thus creating a simplified "cascading" unit process configuration. The char is admixed with the hydrocarbon liquid to produce Applicants' novel fluidic fuel slurry system. In another aspect, minor amounts of methanol and/or water are admixed with the slurry to enhance the rheology and reduce the thermal $NO_x$ upon combustion.

One or more of the following co-products are generated by the process of the instant invention: (1) BTX, a chemical feedstock; (2) naphtha, a gasoline additive; (3) elemental sulfur (derived from cleaning up the $SO_x$ producing substances in the coal); (4) ammonia (derived from cleaning up the $NO_x$-producing substances in the coal); (5) methanol, which, when combined with ethanol and/or gasoline, creates a clean burning, oxygenated motor vehicle fuel; and when added to the slurry reduces (6) $CO_2$, which is used for tertiary oil recovery; and (7) the novel char/hydrocarbon fluidic fuel slurry system of the instant invention.

The fluidic fuel system, which contains only sufficient water to form an emulsion in accordance with a preferred embodiment, is therefore characterized as a non-aqueous hydrocarbon fluidic slurry fuel system which does not contain coal. The fuel system is comprised of solid carbon (char) and process hydrocarbon oils, both of which are derived solely from coal. The system preferably contains about 50% by weight solids (char); and has a heating value of from about 12,000 to as much as 15,000 Btu/lb. This fluidic fuel system is an economical substitute for coal and, in some instances, fuel oil. The fuel system does not require special slurry pipelines, but can be shipped in standard petroleum (oil) pipelines and transported in oil-type tankers throughout the world at about the same cost as for transporting crude oil. This type of transport and handling eliminates the need to construct new slurry pipelines. The fluidic fuel system produced by the process of the instant invention is an economical fuel which can be efficiently and economically exported. The fluidic fuel, as well as the BTX, naphtha, methanol, sulfur, and ammonia co-products, can also be rail transported in the same manner as petroleum products. The fluidic products may be exported without legal restrictions and represent a viable means of shipping U.S. coal derived products into Pacific Rim and other foreign markets.

Because the fluidic fuel is a manufactured, uniform fuel, the only external combustor retrofitting required will be to make the combustion systems capable of accepting a high Btu, fluidic fuel. Burners for coal/oil mixtures are commercially available and can easily accommodate the fluidic fuel product. Because the fluidic fuel is a uniform product, contains methanol, which lowers the flame temperature, and char, which is more reactive than coal and, therefore, combusts at a lower temperature, combustion of the fluidic fuel occurs at lower temperatures and eliminates hot spots. Therefore, combustion $NO_x$ is very significantly reduced and the need for scrubbers and special combustion systems is minimized or eliminated.

In another aspect, a two stage reactor system is provided wherein steam, oxygen and product gas are substoichiometrically oxydized in a first zone to produce CO, $H_2$ and heat. The gas and heat produced in the first zone are intimately admixed with a carbonaceous material in a second stage reaction zone to hydrodisproportionate the coal to hydrocarbon liquid, gases, and solid char.

In a further aspect, sulfur-containing and nitrogen-containing compounds are reduced in the products so as to effectively negate the need for utilization of combustion and postcombustion pollution control devices.

In a further aspect, methanol is simultaneously and effectively produced from the purified reactor gases in a "once-through" process prior to returning the gas to the two stage reaction hydrodisproportionation scheme.

In a further aspect, the water inherent in the coal and that produced in the reactor are concentrated and then used as emulsification water in the slurry to avoid any effluent from the process facility.

In a further aspect of the invention, the rheology characteristics of the liquid-solid mixture, which includes a particulate coal char portion dispersed in a liquid organic fraction, can be advantageously altered by admixing therewith an amount of fluidic aqueous mixture effective to enhance the pumpability characteristics of the slurry without substantially deleteriously affecting the heating value. In another aspect, a hydrophyllic surfactant is admixed with the aqueous phase. In another aspect, the aqueous phase is discontinuous. In a further aspect, the fluidic aqueous mixture comprises from about 0.1% to about 20% by weight of the slurry. In accordance with the process of the instant invention, both the amount of produced water and the viscosity of the hydrocarbon phase are varied by varying the process parameters during hydrodisproportionation. In a further aspect, at least a portion of the liquid organic fraction derived from the hydrodisproportionate is further hydrotreated to enhance the Btu's and the viscosity characteristics of the liquid. In another aspect, methanol produced as a co-produce is admixed with the char/hydrocarbon mixture in order to reduce thermal $NO_x$ and alter rheology characteristics. In accordance with the method of the instant invention, a fuel composition having advantageous rheology characteristics which can be varied to fit certain transportation media as well as modified to accommodate certain feedstocks, is produced by subjecting coal to hydropyrolysis to produce a particulate coal char which is admixed in suitable proportions with a liquid organic fraction and an amount of water effective to enhance the rheology characteristics to produce a solid/liquid fluidic mixture, ie., a slurry which is transportable using existing pipelines.

In a further aspect, the particulate coal char can be admixed with raw coal, upgraded coal, petroleum coke and the like to yield a high Btu, reduced pollutant fuel for char- or coal-fired combustion devices. Likewise, the liquid hydrocarbon can be used itself as a fuel or admixed with other organic liquids such as liquid petroleum distillate or alcohols, such as those produced from grains or the synthesis of coal, in order to vary the rheology characteristics of the liquid fuel.

In accordance with the invention, the rheological characteristics can be varied by varying the percentage by weight of water containing liquid, the amount of methanol, the viscosity of the organic liquid, and the size and distribution of the solid carbonaceous material in the slurry as well as by coating the solid with an organic material to reduce liquid absorption. The char produced by hydropyrolysis is sized and otherwise mechanically and thermally treated to yield a particulate coal char of a distribution to advantageously effect loading of the solid. The liquid organic fraction obtained from the hydrodisproportionation of coal is treated and admixed with the particulate char in proportions so as to form the fluidic, liquid/solid, combustible fuel mixture. The fluidic aqueous mixture is then added (with or without surfactant) and the mixture preferably agitated to produce an emulsion, with the water forming the discontinuance phase. The amount of water is effective to produce a slurry suitable for pipeline transport and combustion directly in combustion systems. In one aspect, the liquid organic fraction is beneficiated to remove sulfur or nitrogen pollutants. This is advantageously accomplished during hydropyrolysis.

In accordance with another embodiment, the rheology of the slurry is altered by admixing therewith a portion of a lower chain alcohol, which alcohol is preferably produced by well-known synthetic methods utilizing coal and water or natural gas. In accordance with a greatly preferred embodiment, the alcohol is produced from the gases liberated during the process, thus producing all the fuel system components from a single, completely self-contained process system. In a greatly preferred embodiment, methanol is produced in a once-through methanol process.

The utilization of the particulate char allows a high packing of the solid particulate matter for a given fluidity of the mixture, thus allowing high loading without adversely affecting the rheology characteristics. Thus, not only does one obtain the aforementioned advantages, but the energy requirement necessary to pump each Btu of fuel energy is significantly reduced. The slurry composition in many aspects possesses thixotropic characteristics. In a further advantageous embodiment, the char is ground and sized to yield a particulate distribution which is bimodal or trimodal. The use of a bimodal or trimodal particulate char distribution enhances the packing of the solid for a given set of slurry flow characteristics.

In a further aspect, coal and/or char is beneficiated to remove ash such that the resultant slurry is combustible directly in internal combustion engines and oil-fired boilers.

Utilizing short residence time hydrodisproportionation (SRT-HDP), the instant process produces a carbon-rich, low contaminant solid char and liquid hydrocarbons that are similar to those derived by refining petroleum. The produced char and coal-derived, medium-viscosity liquid hydrocarbons can be mixed to produce the fluidic fuel product. This process produces a cost competitive fuel, derived exclusively from coal, which alleviates the inherent problems of using coal: $NO_x$ and $SO_x$ pollutants, solid handling problems, low heat value, non-uniform product. This novel fluidic fuel system takes advantage of oil-based energy systems (ease of handling, pipeline transportation and fluidic fuel combustion).

BRIEF DESCRIPTION OF THE DRAWINGS

FIG. I is a flow sheet schematic for the coal hydrodisproportionation process of the present invention where numbered blocks refer to unit process steps and/or facilities as contemplated by the practice of the instant invention and described in the following specification.

DESCRIPTION OF THE PREFERRED EMBODIMENT

Figure 1:
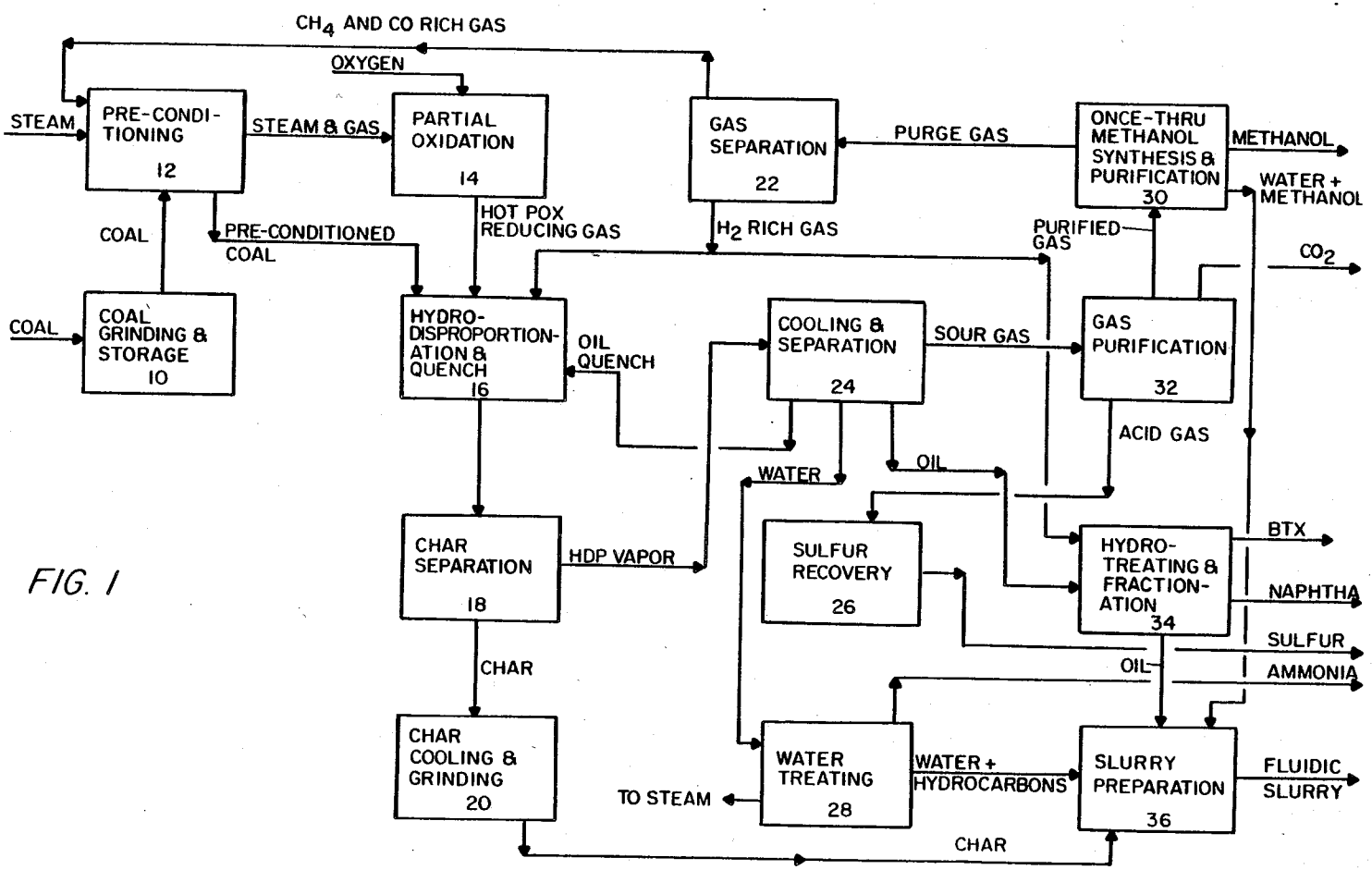

The facilities used in the practice of the instant inventive process comprise the processing units and ancillaries required to produce the fluidic fuel system and the slate of co-products. They represent a "cascading step down", energy efficient, economical design. In one embodiment, power is generated on-site, preferably in a cogeneration facility as further described. In another embodiment, electric power is purchased from a local utility. The only external raw material (other than air and the coal feedstock) which is required is make-up cooling water.

The process of the instant invention commences with coal feedstock (−2") received at the plant battery limits. The feedstock is conveyed to coal grinding unit 10 where the coal is reduced preferably to 70% minus 200 mesh and higher moisture coals are partially dried to from about 4% to about 12% by weight, and preferably 8% by weight, moisture. The sized and partially dried coal is pressurized in lockhoppers and fed to a preconditioning unit 12 that pre-conditions and preheats the coal by direct contact with superheated steam and recycled gas from gas separator unit 22. Steam, recycled gas and oxygen from the air separation plant (not shown) are reacted as first stage reactions in partial oxidation (POX) unit 14 to produce a hydrogen rich gas at a high temperature (as later more fully described). The hot POX gas provides the heat, hydrogen, and reducing atmospheres (CO) necessary for SRT-HDP of the carbonaceous material in second stage reactions as well as the make-up hydrogen needed for hydrotreating the HDP liquids in the downstream hydrotreating and fractionation unit 34.

The pre-conditioned coal from unit 12 is contacted with the hot POX gas from unit 14 and by hot recycled hydrogen from gas separation unit 22 in an SRT-HDP reactor and quench unit 16. The coal is rapidly hydrodisproportionated to char and HDP vapors. The residence time in the reactor is from about 0.2 seconds to about 2.0 seconds. In order to prevent cracking and continued reactions (polymerization) of heavy unsaturated hydrocarbons, the HDP vapor is immediately quenched in the lower portion of the SRT-HDP reactor with recycle liquid, preferably in a preliminary or up stream quench of heavy oil and subsequently a secondary or down stream light oil/water mixture quench.

The char produced is separated from the HDP vapors in the char separation unit 18 and most of the char is sent to cooling and grinding (sizing) unit 20. A small amount of the hot char is sent to a steam boiler, for example, a fluidized bed boiler (not shown), where it is combusted to produce steam required for preconditioning unit 12. The water to produce the steam is obtained from the water treatment unit 28. The cooled and sized char (32% minus 325 mesh) is mixed with hydrotreated oil, methanol and an emulsifying amount of water to produce the fluidic slurry fuel system of the instant invention in slurry preparation unit 36.

The hot HDP vapors are cooled to recover heat and scrubbed to remove residual char dust in cooling and separation unit 24. The condensed oil and water are separated. The separated oil is sent to hydrotreating and fractionating unit 34.

The separated water is stripped in water treating unit 28 to remove dissolved gases and ammonia. Anhydrous ammonia is then recovered as a co-product and sent to storage (not shown). The stripped water is concentrated in unit 28 where dissolved organics and salts are concentrated in a small fraction of the water. The concentrate which is high in hydrocarbon content is then moved to slurry preparation unit 36 for use as emulsifying water in the preparation of the fluidic fuel system. The distillate water from the concentrator is used to produce steam in the steam boiler (not shown). Thus, there is no water discharge effluent from the facility.

The non-condensed cooled sour gas from unit 24, which has been scrubbed to remove char dust, is conveyed to the gas purification unit 32 where sulfur compounds, trace impurities and most of the carbon dioxide are removed. Naphtha range hydrocarbons in the gas are also removed in unit 32 and moved to hydrotreating and fractionating unit 34. The removed sulfur components are sent to a sulfur recovery unit 26 where the sulfur is recovered by conventional means as a co-product and sent to storage (not shown). The separated $CO_2$ is compressed by conventional means to 2000 psia and removed by pipeline (not shown) as a co-product for use in enhanced oil recovery.

The purified gas from gas purification unit 32 is sent to a "once-through" methanol synthesis unit 30 where, on a single pass, part of the $H_2$, CO and $CO_2$ in the gas is converted by the catalytic converter to methanol and water. The crude methanol produced is purified in unit 30 by, for example, distillation, and pure methanol is separated and moved to storage (not shown). A high concentration of methanol in a water stream (up to 95% methanol by volume) is also separated and moved to the slurry preparation unit 36 for preparation of the fluidic fuel system. This stream negates the necessity for expensive methanol purification while providing a diluent and thermal $NO_x$ supressant to the fluidic fuel. Unreacted gases are purged from the methanol synthesis unit and moved to gas separation unit 22.

In gas separation unit 22, the purged gas from methanol synthesis is separated into two streams; a hydrogen rich gas and a methane-carbon monoxide rich gas. Part of the separated hydrogen-rich gas is compressed and heated prior to recycle to the SRT-HDP reactor in unit 16. The remainder of the hydrogen rich gas is sent to hydrotreating and fractionation unit 34. The methane-carbon monoxide rich gas is preheated in the boiler (not shown) and then recycled to the pre-conditioner unit 22.

The separated naphtha-containing BTX is hydrotreated and the BTX is then separated by extractive distillation in unit 34. The BTX and naphtha are removed to storage (not shown. The separated oil (380° F.+boiling hydrocarbons) is also hydrotreated in unit 34. The hydrotreated oil is moved to unit 36 to be mixed with char to produce the instant fluidic slurry fuel. This hydrotreated oil has a heating value in excess of 19,000 Btu/lb and is substantially devoid of $SO_x$ and $NO_x$ producing compounds.

Unit 10—Coal Preparation (Grinding)

Unit 10 includes coal receiving, storage, reclaiming, conveying, grinding and drying facilities required to prepare the coal for introduction to the pretreatment unit 12. In a continuous process, coal storage is live. This unit 10 also includes facilities to grind or pulverize the feed coal from a received size of 2×0" inches to 70 percent minus 200 mesh; and to dry the coal to from about 4% to 12% by weight and preferably 8% by weight moisture.

Coal is stored, weighed, and fed into pulverizers which can be of any type well known in the art. The pulverizers are swept with a stream of heated gas which partially dries the coal. Pulverizer temperature is maintained at from about 120° to about 200° F.

The ground coal is pneumatically conveyed to a set of cyclones located in coal preconditioner unit 12. Part of the gas from these cyclones is returned to the pulverizer circuits and the remainder of the gas is sent to a bag house prior to being vented to the atmosphere. Fugitive dust collectors are provided at transfer points to minimize coal dust emissions to the atmosphere.

Unit 12—Coal Preconditioner

Unit 12 includes coal pre-conditioning with steam and $CH_4$/CO rich gas. Pneumatically conveyed coal from coal grinding unit 10, is fed to a cyclone separator to separate the coal from the transport gas. Most of the transport gas is recycled back to coal grinding unit 10. A slip-stream is diverted to a bag filter to remove entrained coal dust prior to exhausting to the atmosphere. The coal from the cyclone separators and bag filter is sent to a coal feed surge bin. The lockhoppers are pressurized with high pressure nitrogen from the air separation plant. After the upper lockhopper is filled with coal, it is then pressurized prior to its discharging coal to the lower lockhopper. The emptied upper coal lockhopper is then depressurized to atmospheric pressure and is again filled with coal from the surge bin. Lockhopper valves are controlled by a microprocessor unit which is used to control the coal filling, pressurization, coal feeding and depressurization sequence.

Within coal preconditioner unit 12, coal from the lockhoppers is contacted with $CH_4$/CO rich recycle gas and steam at from about 100 psig to about 1,200 psig, and preferably 600 psig, at a temperature from about 800° F. to about 1050° and preferably about 950° F. in the pre-conditioning step which takes place in a fluidized bed vessel. The residence time in the pre-conditioner varies from about 30 seconds to 3 minutes depending on the denied temperature, coal particle size distribution and throughput rate. The superheated steam and gas pre-heats and pre-conditions the coal prior to the coal being fed to the HDP reactor within unit 16. Steam, gas and entrained coal from the fluidized bed is fed to a separator where the coal is separated and returned to the fluidized bed while the resultant steam and gas stream from the separator is sent to a POX reactor (unit 14).

Unit 14—POX Unit

Unit 14 includes production of hydrogen, high quality heat and a reducing atmosphere (CO) for the disproportionation reaction as well as production, producing all of the as well as for naphtha, BTX and oil hydrotreating. This is accomplished solely from hydrogen inherent in the coal feedstock which includes the water as a hydrogen donor. In the POX reactor, the methane-carbon monoxide rich gas and steam is sub-stoichiometrically reacted with oxygen to produce a hydrogen rich gas, CO, and high quality heat. The hydrogen rich gas, the CO and unreacted steam from the POX reactor are at a high temperature and provide the required heat and reducing atmosphere necessary for hydrodisproportionating the coal. Recycle hydrogen from the gas separation unit 22 is heated to about 1000° F., then mixed with the hot POX reducing gas to provide a uniform gas temperature prior to being injected into the HDP reactor.

Unit 16—Hydrodisproportionation and Quench

The coal hydrodisproportionation and quench unit 16 is nominally designed to convert 10,000 tons per day of coal (MAF basis) to HDP vapors and char. The unit is designed for a SRT-HDP reactor temperature range of from about 1,000° F. to about 1,650° F. at a pressure of from about 100 to about 1,200 psig with residence time from about 0.2 of one second to about 2 seconds.

Coal from the pre-conditioner unit 12 is fed to the HDP reactor, which comprises the second stages of the reaction in accordance with the instant invention, by gravity and differential pressure. The coal is preferably injected into the reactor through a central feed nozzle where it is rapidly heated and disproportionated at from about 900° F. to about 1,600° F., and preferably at about 1200° F. The reactor residence time is from about 200 milliseconds to about 2 seconds, with 600 milli-seconds being nominally preferred. Upon disproportionation in the reactor, the volatiles, ie., the HDP vapor, are immediately subject to an instant quench with predominantly recycle heavy oil and tar, the temperature of which is approximately 100° F. less than the temperature of the volatiles, and preferably to a temperature of about 1,100° F. and then to a temperature of about 850° F. with recycle water and oil to prevent reaction (polymerization) of unsaturated hydrocarbons and free radicals. This two-step quench minimizes formation of high viscosity tars. The heavy oil and tar quench thermally cracks the heavy hydrocarbon while acting as a direct heat exchanger.

Unit 18-Char Separation

The quenched HDP vapor and char is sent to a primary char separator where most of the char is separated from the vapor. The vapor stream is then sent to a secondary separator to remove additional char. The vapor, now containing only a small amount of char dust, is conveyed to cooling and separation unit 24.

The separated char is fed to a lockhopper system for depressurization to atmospheric pressure. Char discharging from the lockhoppers is fed to char surge bins. The char from these storage bins is then pneumatically conveyed with nitrogen to char cooling and grinding unit 20.

Unit 20-Char Cooling and Grinding (Sizing)

This unit includes facilities for cooling and sizing char prior to mixing the char with hydrotreated oil from hydrotreating and fractionation unit 34 to produce the instant fluidic fuel system. This unit cools char from about 850° F. to about 145° F. and has the capability of pulverizing char to 95%−325 mesh.

Part of the pneumatically conveyed hot char from char cooling and grinding unit 20 is diverted to a boiler, for example, a fluidized bed boiler (not shown), to generate the steam required in preconditioning unit 12. The remainder of the char is cooled to about 520° F. by generating 600 psig steam in a series of heat exchangers also for use in preconditioning unit 12. The char is further cooled to 145° F. by cooling water in a second set of heat exchangers. The cooled char is sent to a separator where the char is separated from the carrier gas (nitrogen) before going to storage bins. (Nitrogen is a surplus by-product of oxygen manufacture). The cooled char is fed to nitrogen swept pulverizers. The pulverized char is pneumatically transported to a cyclone separator where it is separated from the nitrogen carrier gas. The separated nitrogen is sent to a bag filter to remove char dust prior to being vented to the atmosphere.

Unit 36-Slurry Fuel System Preparation

This unit 36 mixes pulverized char, hydrotreated oil, methanol and water to produce the substantially combustible fluidic slurry fuel system of the instant invention. Preferably, this slurry is a three phase system comprising solid char, hydrocarbons and water to form an emulsion. Cooled, pulverized char from char cooling and grinding unit 20 is fed to a pulverized char storage bin. The pulverized char is fed through a feeder to a slurry mix tank where the char is mixed with hydrotreated oil from hydrotreating and fractionation unit 34, hydrocarbon-rich condensed water from the condensor in unit 28, and a methanol/water mixture from methanol synthesis unit 30. The fluidic fuel slurry product from the mix tank is then pumped to storage (not shown).

Unit 24-Cooling and Separation (Fractional Condensation)

This unit includes all of the processing required to scrub char dust from the HDP vapor, cool and condense the HDP vapor from char separation unit 18.

Cooling and separation unit 24 accepts HDP vapor having a temperature of from about 400° F. to about 1,000° F. and preferably 850° F. and cools the incoming HDP vapor to a temperature of about 105° F. in four consecutive cooling steps. Unit 24 also condenses and collects liquid hydrocarbons and water for separation in an oil-water separator. This unit 24 is also designed to scrub ammonia to less than 10 ppm in the gas before being sent to gas purification unit 32.

In a first cooling step, HDP vapor at about 850° F. from char separation unit 18 is cooled to about 500° F. in a heat exchanger. Saturated steam is generated in this exchanger. The partially cooled HDP vapor stream is sent to a scrubber and then to a vapor-liquid separator where condensed heavy hydrocarbons are separated from the cooled vapor stream. Part of the condensed liquid from the bottom of the separator is re-circulated to the scrubber where it contacts the HDP vapor stream to remove residual entrained char dust from the HDP vapor. The remainder of the condensed heavy oil is recycled to the HDP and quench unit 16 as the primary quench fluid.

In a second cooling step, the HDP vapor at about 500° F. is circulated through a second heat exchanger where it is cooled to about 300° F. by generating lower temperature saturated steam. This cooled stream is moved to a second separator where condensed oil and water are separated from the vapor. The separated liquids are separated in an oil-water separator in unit 24.

Vapor from this second separator is circulated through a third heat exchanger in a third colling step where it is further cooled to about 290° F. by preheating boiler feed water. The liquid-vapor stream then goes to a third separator for separation of the liquid from the vapor. The separated liquid stream (oil and water) is sent to an oil-water separator.

In a fourth cooling step, vapor from the third separator is sent to an air cooler where it is cooled to 145° F. with air and then cooled to 105° F. by a water cooled exchanger.

The cooled vapor-liquid stream goes to a fourth separator (bottom section of the ammonia scrubber) where the light condensed oil and water are separated. The vapor then goes to a packed bed section in the ammonia scrubber where it is contacted with water to remove any remaining ammonia and hydrogen cyanide. Part of the condensed oil and water from the bottom of the ammonia scrubber is used as the final quench liquid for the hot HDP vapor produced in the SRT-HDP reactor. The remainder of the condensed light oil and water is sent to an oil-water separator within the cooling and separation unit 24.

The oil-water separator in unit 24 is designed to separate the condensed oil from water in the three oil/water streams and to provide intermediate storage of the separated oil and water streams.

The heavy oil-water stream from the second separation is cooled and sent to a heavy-oil expansion drum where the pressure is reduced and where most of the dissolved gases in the heavy-oil water mixture are released. The de-gassed heavy oil-water mixture is sent to a heavy oil separator where heavy oil is separated from lighter oil and water. The lighter oil and water are then sent to another oil-water separator where the light oil is separated from the water. The separated heavy oil and light oils are then sent to an oil run-down tank. Water from the bottom of the separator is sent to a sour water storage tank.

The medium oil-water stream from the third separator is cooled, then mixed with the light oil-water stream from the fourth separator and sent to a medium and light oil expansion drum. The released gas is mixed with the gas from the heavy oil expansion drum and then cooled to 105° F. in an water cooled heat exchanger. The oil-water mixture from the expansion drum is sent to a separator where the oil is separated from the water. Separated oil is sent to the oil run-down tank. The oil is then pumped to the hydrotreating and fractionation unit 34. Water from the bottom of the oil separator is sent to the sour water tank before being sent to unit 28 water treating.

Unit 28-Water Treating

Unit 28 strips acid gas and ammonia from various process water streams and recovers anhydrous ammonia with a purity of greater than 99.5 wt. percent. This area also reclaims excess process water by utilizing a brine concentrator. Reclaimed water is re-used in the plant as previously described. Concentrate, containing dissolved organics and salts, is admixed with the fluidic fuel in unit 36 slurry preparation. As example of the water treatment/ammonia stripping and recovery section is a proprietary process licensed by United Engineers and Consultants (subsidiary of U.S. Steel).

Sour ammonia-containing water is sent to an ammonia still (stream stripper) where acid gas and free ammonia are stripped from the water. Stripped water from the bottom of the ammonia still is sent to flash drum where a small amount of the water is flashed and recycled to the still. Remaining water from the flash drum is separated into two streams. One stream goes to a water cooled exchanger where the stripped water is cooled. The second stream is sent to a brine concentrator where dissolved solids and organics are concentrated in a brine stream. The concentrate is sent to slurry fuel system preparation unit 36.

The stripped ammonia and sulfur-containing acid gas from the ammonia still are sent to an ammonia absorber where the ammonia is selectively separated from the acid gas, utilizing, for example, a lean ammonium phosphate solution as the solvent. The acid gas from the absorber overhead is sent to the sulfur recovery unit 26, which may be, for example, a Claus unit. The anhydrous ammonia, after separation from the water, is condensed and pumped to storage (not shown).

Unit 34 Hydrotreating and Fractionation

Unit 34 hydrotreats, hydro-desulfurizes and hydrodenitrofies naphtha and oil produced in the hydrodisproportionation of coal. This process renders these co-products substantially non-polluting, ie., no $SO_x$ or fuel $NO_x$. This unit area is divided into two sections: a naphtha hydrotreating/BTX recovery section and an oil hydrotreating/fractionation section.

The naphtha hydrotreating section de-sulfurizes and denitrofies the naphtha to less than 1 ppm and 0.1 ppm respectively. A commercial grade BTX product is recovered along with a naphtha product, both of which are gasoline blending stock and/or chemical feedstock.

The oil hydrotreating section hydrotreats and stabilizes the oil such that it will not polymerize, and desulfurizes the oil to less than 0.15 percent sulfur. The oil hydrotreater also reduces nitrogen to less than 2000 ppm and oxygen to less than 100 ppm. This process renders the fluidic fuel produced from this oil substantially free of fuel $NO_x$ and $SO_x$ pollutants in accordance with one aspect of the instant invention.

Unit 32-Gas Purification

This unit includes all of the gas handling facilities required for gas purification. Gas purification unit 32 purifies sour gas from the cooling and separation unit 24. This unit removes sulfur components to less than 0.2 ppm and removes carbon dioxide to about 3.0 percent so the resultant gas may be used in the methanol synthesis unit 30. The unit also removes from the gas organic sulfur, naphtha range hydrocarbons, and trace quantities of ammonia and hydrogen cyanide. An example of such a commercially available gas purification unit is the "Rectisol" process licensed by Lurgi, Frankfurt, West Germany.

A compressor for carbon dioxide is included in unit 32. $CO_2$ off-gas separated from the sour gas in gas purification unit 32 is sent to, for example, a two case, electric motor driven, centrifugal compressor where the $CO_2$ is compressed in 4 stages with air coolers followed by water cooled exchangers. An air after-cooler followed by a water cooler is also provided to cool the compressed (fluid) $CO_2$ to about 100° F. prior to being sent to a pipeline.

Sour gas from cooling and separation unit 24 is cooled by cool purified gas and refrigerant to condense residual water vapor in the gas. The condensed water is separated from the gas and sent to water treating unit 28.

The de-sulfurized gas then goes to a standard $CO_2$ absorber where most of the $CO_2$ is removed from the gas by, for example, cold solvent extractor. The cold, purified gas is heated by, for example, cross-exchange with the incoming sour gas prior to being sent to methanol synthesis and purification unit 30.

The solvent containing $H_2S$, COS and $CO_2$ from the $H_2S$ absorber is flashed to release dissolved gases ($H_2$, CO, $CH_4$, etc.). The solvent is further depressurized in a series of flashes to remove part of the dissolved $CO_2$. The enriched $H_2S$ solvent stream is sent to hot regeneration.

$CO_2$ rich solvent from the $CO_2$ absorber is flashed to release dissolved gases and is then further flashed to remove part of the dissolved $CO_2$. The partially regenerated solvent is recycled to the mid-section of the $CO_2$ absorber.

The released $CO_2$ from the $CO_2$ flash tower and from the $H_2S$ reabsorber are combined, heated and sent to the $CO_2$ compressor and then to a $CO_2$ pipeline.

$H_2S$ rich solvent from the $H_2S$ reabsorber is heated by cross exchange with hot regenerated solvent from the regenerator and then stripped in the hot regenerator to separate dissolved $H_2S$, COS, $CO_2$ and light hydrocarbons. The stripped gas is sent to sulfur recovery unit 26.

The solvent stream from the bottom of the $H_2S$ absorber containing naphtha and dissolved gases is flashed in a pre-wash flash tower. The flashed gases are recycled to the $H_2S$ re-absorber. The solvent-naphtha stream from the flash tower is sent to a naphtha extractor where the naphtha is separated from the solvent. The recovered raw naphtha is sent to hydrotreating and fractionation unit 34. The water-solvent stream from the extractor containing some naphtha is sent to an azeotrope column. Residual naphtha, dissolved gases and some water and solvent are stripped in the overhead of the azeotrope column and recycled to the pre-wash flash tower. Water-solvent mixture from the bottom of the azeotrope column is pumped to the solvent-water column where the solvent is stripped from the water and sent to the regenerator. Waste water from the bottom of the solvent-water column is collected and sent to water treating unit 28.

Unit 22-Gas Separation

Unit 22 separates hydrogen from purified HDP gases, which are primarily $CH_4$/CO (purge gas), then re-compresses and heats the hydrogen prior to its recycle to the hydrodisproportionation and quench unit 16. In addition, part of the separated hydrogen is sent to hydrotreating and fractionation unit 34 for use in naphtha and oil hydrotreating. Most of the separated gas, primarily methane and carbon monoxide, is heated in the boiler (not shown) and sent to the pre-conditioning unit 12 prior to being partially oxygenated in the POX unit 14.

Purge gas from once-through methanol synthesis unit 30 is sent to a scrubber where any residual entrained solvent is removed by methods well known in the art. The solvent should be removed from the gas or it will foul the membrane separator in gas separation unit 22. Gas from the scrubber is heated prior to going to the membrane separators. In the membrane separator, $H_2$ is separated from the other gases by semipermeable membranes formed, for example, into hollow fibers. The separated hydrogen (containing small amounts of $CO_2$, CO, and $CH_4$) is compressed in a hydrogen compressor. Part of the compressed, hydrogen rich gas is sent to a heater where the hydrogen rich gas is heated and then recycled to hydrodisproportionation and quench unit 16. The remainder of the hydrogen rich gas is sent to hydrotreating and fractionation unit 34. The remainder of the gas is heated and sent to the preconditioning unit 12.

Unit 26-Sulfur Recovery

Unit 26 recovers sulfur from the various sour gas streams produced in the plant.

Acid gas from gas purification unit 32 is sent to an $H_2S$ absorber where hydrogen sulfide and some of the carbon dioxide in the gas in absorbed using, for example, a SCOT solvent. The desulfurized gas, containing primarily light hydrocarbons, hydrogen and carbon dioxide are sent to the plant fuel gas header. The solvent from the absorber containing hydrogen sulfide and carbon dioxide is sent to a solvent stripper where the $H_2S$ and $CO_2$ are stripped from the solvent. The stripped acid gas is then sent to a reaction furnace. The $H_2S$ is converted to elemental sulfur by methods well known in the art. An example of such a device is a Claus unit. The sulfur produced is drained to a sulfur storage (not shown).

Unit 30-Once-Through Methanol Synthesis and Purification

Unit 30 produces crude methanol in a once-through reactor and purifies part of the crude methanol to meet Federal Grade AA specifications in accordance with another aspect of the instant invention. This area also produces a methanol rich water stream for mixing with the fluidic fuel to enhance rheological properties and reduce thermal $NO_x$ emissions. About 50 percent of the methanol produced is mixed with the fluidic fuel to enhance the rheological characteristics and reduce the thermal $NO_x$ of the combusted product. The remainder is used as an oxygenated motor fuel.

Purified gas from gas purification unit 32, is compressed to methanol synthesis pressure in, for example, a turbine driven synthesis gas compressor. Part of the compressed gas is cooled in, for example, a water cooled exchanger and sent to gas separation unit 22. The remainder of the gas is heated by cross exchange with the methanol reactor effluent gas and fed to the methanol reactor. In the reactor, part of the hydrogen reacts with carbon monoxide to produce methanol and a minor amount of hydrogen reacts with carbon dioxide to produce methanol and water. The hydrogen is internally produced as set forth hereinbefore. Small amounts of organics and other alcohols are also produced in the reactor. The preferred reactor is an iso-thermal catalytic reactor. In accordance with this device, the gas flows through tubes containing a catalyst. The exothermic heat of reaction is removed by transferring heat to boiler feed water on the outside of the tubes and generating medium pressure steam.

The effluent gas and methanol from the reactor is partially cooled by preheating the feed gas to the reactor. The steam is further cooled by an air cooler and then a water cooler to condense the contained methanol and water. The non-condensible gas, primarily hydrogen, carbon monoxide and methane with lesser amounts of carbon dioxide, ethane and nitrogen, is purged from the system and sent to unit 22 gas separation. The condensed crude methanol, containing water, dissolved gases, and trace amounts of produced organics, is sent to a pressure let-down drum where part of the dissolved gases and light organics are released. The crude methanol is then sent to a stripper column where the remaining dissolved gases and light organics are stripped. The stripped crude methanol is then sent to a distillation column where pure methanol is recovered in the overhead, condensed and sent to storage. A methanol-rich water stream is recovered in the bottom of the distillation column and sent to slurry preparation unit 36.

An air separation unit (not shown) is used to produce 98.0% gaseous oxygen and liquid oxygen. This oxygen is used in the POX unit 14. This air separation unit also produces gaseous nitrogen and liquid nitrogen.

Air separation technology is well known and any system, such as that provided by, for example, Air Products and Chemicals, Inc., Allentown, Pa., can be utilized.

Coal Feedstock

In accordance with the preparation of the particulate coal char/liquid organic material slurry that is utilized in accordance with the instant invention, raw coal is continuously crushed to particles in the range of 20% minus 200 mesh to produce a pulverized coal product. Advantageously, the crushed coal is then washed and otherwise beneficiated by means well known in the art to remove inorganics such as pyritic sulfur and ash. This process and the size of the coal particle to be beneficiated will be dependent on the rank of the coal, its agglomerating tendencies and the inorganic sulfur and ash content of the coal.

The carbonaceous materials that can be employed as feedstock in the instant process are, generally, any material which will undergo hydropyrolytic destructive distillation to form a particulate char. Bituminous and subbituminous coals of various ranks and waste coals as well as lignite are examples. Peat may also be used. Anthracite is not a preferred feedstock in that the volatiles are minimal. In accordance with one aspect of the instant invention where the slurry liquid organic fraction is derived from hydrodisproportionation, it will be realized by the skilled artisan that coals having lower percentages of volatiles will require use of alcohols or other "make-up" hydrocarbons to produce the pipeline transportable compositions having desirable rheology characteristics. In accordance with a preferred embodiment, methanol is produced directly from SRT-HDP gas in a "once-through" methanol scheme as more fully described herein.

Preferably, coal from the lignite rank to the medium volatile bituminous rank have sufficient volatiles so as to minimize make-up hydrocarbons. Lignites are an advantageous starting material for the instant invention since they contain process water for hydrodisproportionation and manufacture of methanol as well as volatiles up to 55% by weight (on a dry basis). This is advantageous in producing char slurries having higher liquid content with lower viscosity liquids. Additionally, preconditioning of the coal, as disclosed herein, increases liquid yield and lowers the viscosity of such liquids.

The physical properties of the coal are also important in the practice of the instant invention. Coals of higher rank have plasticity and free swelling characteristics which tend to cause them to agglomerate and slake during the hydrodisproportionation process.

The mining and preparation is fully described in Kirk-Othmer ENCYLOPEDIA OF CHEMICAL TECHNOLOGY, second edition, vol. 5, pp. 606–676. The coal is mined by either strip or underground methods as appropriate and well known in the art.

The 2"×0" raw coal is preferably subjected to crushing to reduce the particle size. Particle size is dependent on the properties of the coal as well as the need for beneficiation. In accordance with a preferred embodiment, the coal is pulverized to 70%−200 mesh. The need for size reduction and the size of the reduced material will depend upon the process conditions utilized as well as the composition and rank of the coal material. When beneficiation is necessary, for example, with coals containing a high percentage of ash or inorganic sulfur, the coal is preferably ground and subjected to washing and beneficiation techniques. When coals are used which have agglomerating tendencies, the size of the coal must be matched to the hydrodisproportionation techniques and process conditions in order to produce a particulate char and to prevent agglomeration during HDP.

The crushing, pulverizing and/or grinding is preferably accomplished with impact mills such as counter-rotating cage mills, hammer mills or the like. Advantageously, carbonaceous fines and the like are readily utilized and subjected directly to hydrodisproportionation.

Hydrodisproportionation

In accordance with the instant invention, hydrogen inherent in the feedstock, including that chemically bound in the water present in the feedstock, is "rearranged" to produce a high quality hydrocarbon product and char. The water inherent in the coal as well as that produced in the HDP reactor by the reaction of hydrogen and oxygen is utilized to generate hydrogen while the generation of water is suppressed. This is in contrast to the prior art where external hydrogen and/or the reaction of oxygen and hydrogen is used to generate heat and, as a result, produce water. In accordance with this invention, a partial pressure of steam is maintained in both the POX unit and the HDP reactor vessel to deter the formation of water. Reaction conditions are maintained in the POX unit such as to promote the production of hydrogen by stripping or extracting oxygen from water and/or utilizing water and methane to generate hydrogen as set forth in detail herein.

Thus, in accordance with this invention, CO is used as a reducing agent to react with bound oxygen to yield $CO_2$ and heat as well as to react with water to produce hydrogen. This hydrogen is used to reduce pollutants, ie., generate $H_2S$ and $NH_3$ (by reacting with organic sulfur and nitrogen in the coal), which are removed, produce hydrocarbons, and upgrade the hydrocarbon material. Therefore, the reaction is continually pushed toward the exothermic formation of $CO_2$ as opposed to $H_2O$. Advantageously, formation of $CO_2$ by oxidizing CO is an exothermic reaction which will provide heat in both the POX unit as well as the HDP reactor. This negates the need to produce the majority of the reactor heat with $H_2$ and $O_2$.

In accordance with another aspect of the invention, water from the coal is treated and recycled to a steam generator and superheater along with recycled gas and used as a precondition medium in preconditioning unit 12. Therefore, no process water is discharged from the plant. In unit 12, more water is thermally extracted from the coal, along with light hydrocarbons, in the form of steam and fed directly into the POX unit 14. Therefore, the inherent water in the coal is utilized both as a preconditioning medium and as a hydrogen donor in the POX reactor and the HDP reaction vessel.

The following is set forth as explanation of the hydrodisproportionation (HDP) process and is not meant as a limitation. Hydrodisproportionation, as used herein, is meant to mean a special type of hydropyrolysis wherein rearranging of internal hydrogens occurs. Hydropyrolysis means the destructive distillation (volatilization) of coal in the absence of oxygen but in the presence of one or more hydrogen donors or hydrogen itself. Hydropyrolysis includes steam pyrolysis as well as hydrocarbonization techniques under varying temperature and pressure and atmosphere conditions such as, for example, in the presence of hydrogen, water vapor or hydrogen-donating material. The hydropyrolysis step of the instant invention can be carried out by any apparatus, which is well known in the art, having the ability of reach charring temperatures in the requisite time.

The principle of "rearranging" structures and hydrogens is used in the instant HDP process. Simply put, if coal has a hydrogen-to-carbon ratio of 1, and if the hydrogens on half the carbons could be transferred to the other half of the carbons, then the result would be half the carbons with 0 hydrogens and half with 2 hydrogens. The first portion of carbons (with 0 hydrogens) is char; the second portion of carbons (with 2 hydrogens) is a liquid product similar to a refined petroleum oil. This transfer is accomplished by heating the coal in a reducing atmosphere and in the presence of internally-generated hydrogen in accordance with the present invention. Thus, this is not the hydrogenation process that is used in coal liquefaction.

The solid char and the liquid "oil" from the instant HDP process can then be mixed to form a fluidic fuel which is substantially all hydrocarbons or hydrocarbon derivatives (other than water for rheology and combustion). The organic sulfur and nitrogen content of the char and hydrocarbon "oil" are reduced through the formation of hydrogen sulfide and ammonia during the HDP process. It will be realized by the skilled artisan, once the teaching herein understood, that, depending on the composition of the charge, parameters such as residence time, type of process, type of reactor, temperatures and flow rates may vary. The temperatures and heating rates are also important in determining the viscosity of the liquid. Preferably, the HDP is performed in a continuous process.

Preconditioning

In accordance with the aspect of the instant invention relating to reducing viscosity of the organic liquid through utilization of specific process parameters and increasing the liquid yield from the HDP process, the crushed coal particles are passed continuously through a preconditioner unit 12 which is operated in the range of from about 350° F. to about 650° F. at pressures from 100 psig to 1,200 psig. The moisture is used as process water for the HDP and/or the POX unit as previously set forth herein. The entrained gases which are removed have further value as fuel in the POX or a hydrogen source for the HDP step. Advantageously, the preconditioning is carried out using process heat from the char and hot gases liberated during pyrolysis.

The preferred method of HDP for varying the viscosity and increasing the liquid content is carried out in the presence of water and internally generated hydrogen as previously described. In accordance with this preferred embodiment, preconditioning is preferred in that it offers the greatest flexibility in varying liquid amount and viscosity. Preconditioning is not necessary, however, in the practice of the HDP invention. In a greatly preferred embodiment, a pre-conditioning step is used to increase the liquid yield and reduce viscosity. The exact time, temperature and pressure range depend on the feedstocks and the particular results derived.

In accordance with a preferred embodiment, the preconditioning vessel comprises a fluidized bed wherein steam at temperatures from about 600° F. to about 1,050° F. and preferably from about 800° F. to about 1,000° F. and more preferably at about 950° F. is introduced into the preconditioning vessel in a manner such that the particulate coal is fluidized in the stream of superheated stream at a pressure from about 100 psig to about 1,200 psig and preferably from about 400 psig to about 800 psig and more preferably in the range from about 500 psig to about 700 psig. The velocity of the steam is set so that the coal being preconditioning is suspended in the steam for a period of from about 30 seconds to about 3 minutes. It will be realized that the finer material is entrained in the steam and an internal cyclone separator is employed to remove the entrained particles. The steam and entrained hydrocarbons from the preconditioner are introduced directly into the POX reactor. The exact temperatures and times required will be determined by the rank of the coal to be used as well as the desired rheology of final slurry. In this manner the viscosity and percent loading of the slurry can be matched to the characteristics of the transportation as well as the end-use combustion systems, i.e., the rheology can be varied.

Moreover, neither the preconditioning steam nor the entrained hydrocarbons are emitted into the air but, in fact, are utilized in the POX unit 14. The entrained hydrocarbons are utilized as a fuel source in the partial oxidation reactor to increase heat and produce hydrogen, CO and the like; and the steam is utilized as the water source for hydrogen production in the POX unit 14.

The HDP Reactor

In accordance with the present invention, there is provided a two-stage process for (1) producing internally generated hydrogen, and (2) hydrodisproportionating coal to form solid char, liquid and gaseous hydrocarbons from carbonaceous materials. Broadly, oxygen and steam are reacted with reaction gas ($CH_4$/CO rich) from gas separation unit 22 in the first-stage partial oxidation zone to obtain products including primarily CO, $H_2$, and heat. In the first stage, oxygen is sub-stoichiometrically reacted in the presence of an amount of water effective to substantially inhibit further water formation yet provide a hydrogen donor in accordance with one or more of the following reactions:

$$CH_4+\tfrac{1}{2}O_2 \rightarrow CO+2H_2$$

$$CH_4+O_2 \rightarrow CO_2+2H_2$$

$$CH_4+H_2O \rightarrow CO+3H_2$$

$$CO+H_2O \rightarrow CO_2+H_2$$

Preferably, the first stage of the process is accomplished in a separate unit.

The first-stage reaction products (heat, CO and $H_2$) are utilized in the second-stage hydrodisproportionation reaction zone wherein carbonaceous feed material is introduced into and admixed with the first stage reactants to effect volatilization. The second-stage reaction is accomplished at temperatures in the range of from about 1,000° F. to about 1,600° F., and the second-stage pressures in the range of from about 100 psig to about 1,200 psig. The second-stage reactor products are then rapidly cooled such as to effect a total hydrodisproportionation reaction exposure time of from about two hundred milliseconds to about two seconds. The rapid quench results in a second-stage product slate of gaseous and liquid hydrocarbons including benzene, toluene, and xylene.

In accordance with the present invention, the first and second stage reactions may be accomplished in two separate reactors or within a single vessel. In this latter configuration, the carbonaceous feed is introduced to effect the second stage. The direction of flow of the products through the reactors or vessel is dependent only upon the longitudinal axial alignment of the reactors or single reactor vessel. By utilizing high velocity flows to propel the reactor products through the reactors, the direction of axial alignment of the reactors or vessel may be varied. The important aspect is that the presence of induced oxygen is minimized in the second stage such that the preferential reaction is other than water formation.

In accordance with the instant invention, hydrodisproportionation of bituminous and subbituminous coals or lignites is efficaciously carried out in a short residence time reactor in the presence of a hot reducing hydrogen and water rich atmosphere which is produced in a first reaction chamber, up-stream of the second downstream reactor solely from hydrogen inherent in the feedstock, by partially oxidizing the gas derived from the reaction in the first reactor in the presence of water vapor to form carbon monoxide and hydrogen.

In accordance with the invention, production of hydrogen and heat useful in hydrodisproportionation of carbonaceous material including lignites, subbituminous and bituminous coals, and peat, to produce char and liquids and gases is accomplished by utilizing oxygen, preferably pure oxygen from an air separation plant, methane (or hydropyrolysis gas), and steam which is preferably derived from preconditioning the coal, in a partial oxidation reactor, to produce primarily hydrogen and CO with some $CO_2$.

The hot gas from the POX unit is directly injected into the HDP reactor to heat the coal from the preconditioning unit to volatilization temperatures. Recycled hydrogen from the gas separation unit that is preheated to about 1000° F. is simultaneously fed to the reactor. The coal is heated preferably by intermixing with the gas to from about 1000° F. to about 1600° F. at from about 100 psig to about 1,200 psig and is hydrodisproportionated with the volatilized material undergoing partial hydrogenation. The reactants and products are directly quenched, preferably in a two stage process, from recycled quench oils to about 850° F.

The following example is utilized to demonstrate the feasibility of the instant invention. The HDP facility is designed to convert 10,000 tons (moisture, ash free) per day of coal feed to a char/hydrocarbon slurry (one composition of which is set forth later herein) and co-products. Dry pulverized coal at 180° F. is fed to a preconditioner unit 12 and contacted and fluidized with 550 psig, 950° F. steam at a rate of 250,000 lbs per hour and recycled $CH_4$/CO rich gas also heated to 950° F. in a fluidized bed vessel. The coal from the preconditioner unit 12 at 480° F. is separated from the steam and gas and fed to a SRT-HDP reactor in hydrodisproportionation and quench unit 16. 70,000 lbs per hour of recovered hydrogen preheated to 1000° F. is recycled to the HDP reactor. Steam and gas from the preconditioner at about 480° F. is sent to a cyclone separator to separate entrained coal particles. The steam and gas are fed to a POX unit 14. The steam and recycled gas are reacted with about 150,000 lbs per hour of oxygen (substoichiometrically) to produce a hydrogen-rich reducing stream containing water at about 2,000° F. and 525 psig. The hot gas from the POX unit is directly fed to the SRT-HDP reactor operating at about 500 psig to heat the coal and recycle hydrogen to about 1150° F., at which temperature the coal is volatilized and the volatilization products are partially hydrogenated. The HDP vapors and char are immediately quenched to about 850° F. with about 230,000 lbs per hour of recycled quench oils.

The char is separated from the gas and HDP vapor, depressurized to atmospheric pressure, cooled through a heat exchanger (not shown) and sent to char cooling and grinding unit 20. The gas and HDP vapor is further processed as shown in FIG. I to produce liquid hydrocarbons, purify non-condensible gases, separate hydrogen for recycle to the reactor, and recover gas for recycle to the POX unit 14. Char and hydrotreated oil is admixed with a methanol-rich water stream to produce the fluidic fuel in slurry preparation unit 36. This example illustrates the advantage of the invention producing hydrogen and heat in a first stage reaction for volatilizing the carbonaceous material in a second stage.

The two stage process of the instant invention can be utilized for the hydrodisproportionation of any solid or semi-solid or even liquid carbonaceous material in particular. Preferably, oxygen is introduced to the POX unit 14 in sub-stoichiometric amounts to maintain the desired operating temperature range in the second stage volatilization. Sufficient steam is added to effect an adequate supply of hydrogen for the second-stage HDP process and to inhibit the production of water. The amounts are empirical to the feedstock and desired product slate. Steam requirements are therefore dependent upon the second-stage carbonaceous material feed rate, the type of carbonaceous feed introduced, and the operating conditions in the second stage, etc.

Higher temperatures and longer high temperature exposure times in the second stage create a need for greater amounts of hydrogen in the second stage as heavy hydrocarbons are cracked to lighter material. In order to meet second stage hydrogen requirements, for example, 0.05 to 0.25 lbs of $H_2$ per one lb. of carbonaceous material is required to be fed into the second stage.

It will be realized that the concept of the instant invention, ie., the rearranging of hydrogen and the utilization of hydrogen from constituents in the carbonaceous material, has limits. That is, the amount of hydrogen that can be produced in this manner is finite. It has been found, however, that, especially with greener coals, gasification of hydrocarbons, cracking of heavier material, and even hydrogenation of some portion of the solid carbon is possible. It will be realized that the more hydrogen in the feedstock, the more valuable is the fuel produced. The instant invention is, therefore, meant to cover so-called gasification, partial gasification and variations thereof.

Hydrodisproportionation Reactor

In accordance with a preferred embodiment of the instant invention, a refactory lined reactor vessel is utilized to volatilize the carbonaceous material. This vessel can act as a vessel for the stage one reaction and the stage two reaction, or for the stage two reaction, only. The preferred reactor configuration comprises an inlet portion having a centrally located coal feed portion and annularly forwardly located impinging hot POX hydrogen gas input feed inlet to provide a complete mixing of the solid gas stream to effect a rapid heat rate as further set out herein. The velocity of the feed and the volume are such that, at a specific temperature as set out above, the residence time is from about 200 milliseconds to about 2 seconds.

Anterior of the reactor vessel, disposed in an annular fashion about the circumference of the vessel, are one or more sets of quench nozzles through which a quench medium is dispersed to terminate the reaction and reduce the temperature of the reaction gas (HDP vapor).

Another embodiment of the two-stage process reactor is a vessel wherein the outlet end of a POX reactor section to accomplish the first stage reaction is connected directly to the inlet end of a reaction section designed to accomplish the second-stage reaction. The two reactor sections can comprise two physically separate compatible reactors utilizing a high product flow rate, short-residence time, entrained-flow reactor; or the two reaction stages may be integral parts or zones of a single unit. The direction of axial alignment of the reactor is not important since high velocity entrained flow is not gravity dependent so long as the injectors provide the high rate of flow and short exposure time required to achieve the desired product slate.

Other embodiments of the two stage process are possible utilizing either a single vessel or separate reactors. The direction of product movement through the first and second stages is not limited to either upflow or downflow when a high velocity propelling force is used to overcome gravitational forces and to insure proper heating profiles and rapid product movement through the reactors.

Product Slate

The carbonaceous feed material is rapidly heated by the first-stage product stream resulting in its rapid devolatilization and hydrodisproportionation. It has been found that the presence of CO, $CO_2$, $CH_4$, and $NH_3$ in the second stage does not inhibit the production of benzene, toluene, xylene and other liquid products in a short-exposure time, high-temperature hydropyrolysis. $CH_4$ and $CO_2$ are merely diluents which have little effect on the second stage reactions. The concurrent presence of water vapor is required to prevent the formation of water ($1H_2+\frac{1}{2}O_2 \rightarrow H_2O$) and the net reaction extracts hydrogen from water to provide some of the hydrogen consumed in the hydrogenation reactions. Hydrogen is indirectly extracted from water vapor in the first stage to satisfy the hydrogen needs in the second stage.

The HDP product slate includes: benzene, toluene and xylene, from about 1% carbon conversion to about 20% carbon conversion. Carbon conversion is defined as the weight ratio expressed as a percentage of the carbon found in the second-stage end products to the total amount of carbon in the second-stage carbonaceous feed material. The second-stage product slate also includes $C_1$–$C_4$ gases, from about 5% carbon conversion to about 80% carbon conversion, and liquids having a boiling point less than 700° F. (excluding BTX) from about 1% carbon conversion to about 30% carbon conversion.

The short exposure time in the HDP is conducive to the formation of aromatic liquids and light oils. It has been found that rapid heating of carbonaceous materials not only "drives out" the volatiles from the feed particles (devolatilization), but also thermally cracks larger hydrocarbons into smaller volatiles which escape from the host particle so rapidly that condensate reactions are largely bypassed. With a rapid quench, these volatiles are stabilized either by reaction with hydrogen to form a less reactive product or by lowering the internal energy of the volatile below its reactive energy level. The net result is the rapid production of volatiles and then a rapid stabilization of these volatiles before they can degrade to low molecular weight gases or polymerize the solids.

After cooling, the second stage product slate includes, but is not limited to, naphtha, benzene, toluene, xylene, and $C_1$–$C_4$ gases. Operating conditions in the second stage reactor may be regulated to also obtain significant amounts of the following additional products: (1) gasification mode-hydrogen, water, carbon monoxide, carbon dioxide, hydrogen sulfide, and lesser amounts of −700° F. boiling point oil consisting of a mixture of light aromatic and aliphatic hydrocarbons and ammonia; (2) petrochemical mode-hydrogen, water, carbon dioxide, carbon monoxide and −700° F. oil with lesser amounts of hydrogen sulfide, ammonia, and $C_3$–$C_4$ hydrocarbons; and (3) liquefaction mode-hydrogen, water, carbon monoxide, carbon dioxide, −700° F. oil and +700° F. boiling point oil consisting of a mixture of heavy aromatic and aliphatic hydrocarbons and lesser amounts of ethylene, hydrogen sulfide and ammonia. The product slates are dependent upon coal type and operating parameters, such as pressure, temperature and second-stage exposure time, which can be varied within the reactor system.

The second stage product gases are useful for the extraction of marketable by-products such as ammonia, as a hydrogen source for hydrotreating the produced oil, as a fuel for use in combustion systems and, most importantly, as a feedstock for the production of lower chain alcohols which can be used as hydrocarbon-rich liquids to alter the viscosity of the slurry liquids and the flow characteristics of the slurry. In accordance with a preferred embodiment, these gases are used primarily to produce lower chain alcohols which are admixed with the liquid organic material to improve the viscosity characteristics of the liquid organic fraction. Advantageously, the gases are "sweetened" prior to being marketed or used in the process. The elimination of potential pollutants in this manner not only enhances the value of the slurry as a non-polluting fuel but also improves the economics of the process since the gaseous products may be captured and marketed or utilized in the process.

Hydrotreating

A preferred embodiment includes a process for further treating the liquid organic fraction to adjust viscosity and thus enhance the rheology. The liquids hydrotreating step is quite well developed. A number of such technologies are readily available in the art. In each case, the paramount consideration is to obtain a maximum amount of liquids having a viscosity consistent with producing a slurry that is capable of pipeline transport and of loading a maximum of a particulate solid coal char while being combustible in liquid-fueled combustion system.

The separated liquid hydrocarbons ("oil") require further treatment to increase the hydrogen-to-carbon ratio and to reduce the sulfur and nitrogen content. This is accomplished in a hydrotreater. The oil is contacted with hydrogen in a catalytic reactor at moderate pressure and temperature. The hydrogen reacts with the sulfur and nitrogen contained in the oil to produce hydrogen sulfide and ammonia and further hydrogenates the oil. Light oil is separated from heavier oil and then further processed to separate benzene, toluene and xylene (BTX) and naphtha.

Once-Through Methanol

In accordance with the instant invention, a purified gas stream from an HDP reactor quench comprises hydrogen, CO, methane and a minor amount of $CO_2$. This feed gas is passed through a standard methanol synthesis and purification unit 30.

The purified gas, which is cycled through the once-through methanol reactor unit 30, can be recycled as a purge gas through a gas separation unit 22 for recycle back to the preconditioner. Only about 20% of the hydrogen fed to the once-through methanol reactor is actually converted to methanol. This particular process, as opposed to prior coal or natural gas methanol synthesis processes, is particularly economically advantageous.

Generally, the conversion rate of methanol synthesis is low and the gas must be recycled and compressed to the synthesis reactor in the prior art scheme. In the instant process, there is no requirement to compress and recycle the purified gas to the methanol synthesis reactor prior to returning it to the POX unit. Therefore, methanol is economically produced as a co-product.

The separation of methanol from water in conventional synthesis processes is energy intensive because all of the methanol must be removed. In the instant process, only part of the methanol is separated and the remaining methanol-rich water portion is utilized in the slurry preparation. Therefore, expensive separation equipment and energy are significantly reduced.

Slurry

The terms "slurry" or "liquid/solid mixture" as used herein are meant to include a composition having an amount of the particulate coal char which is in excess of that amount which is inherently present in the liquid organic portion as a result of the hydropyrolysis process. Examples of slurry formulations from various coal feedstocks are set out in FIG. II.

For most applications the particulate coal char constituent should comprise not less than about 45% by weight of the composition and preferably from about 45% to about 75% by weight. In accordance with one aspect wherein the char is separated from the liquid at the slurry destination, the term 'slurry' is intended to include a composition containing amounts of char as low as 1% by weight, which composition may be further transported, for example by pipeline, to a refinery or to another combustion facility.

If the slurry is to be fired directly into a liquid fueled combustion device, the loading and the liquid organic constituents and the viscosity of the liquids may be varied to maximize combustion efficiency, and, in some cases, amounts of alcohol and "make up" hydrocarbon distillates can be added. This enhances combustion characteristics in a particular combustion system configuration and reduces thermal $NO_x$ as well as enhancing rheology characteristics of the slurry.

TABLE I

| | SLURRY FORMULATIONS | | | | |
|---|---|---|---|---|---|
| COMPONENT WT. PERCENT | POWDER RIVER BASIN, WYO. | MOFFAT COUNTY COLO. | ILLINOIS #6 BRUSHY CREEK | HANNA BASIN WYO. | CHUITNA ALASKA |
| CHAR | 58.80 | 58.20 | 59.00 | 59.96 | 58.31 |
| OIL | 27.80 | 29.93 | 28.43 | 27.21 | 28.78 |
| WATER | 9.58 | 8.36 | 9.50 | 8.39 | 8.94 |
| METHANOL | 3.82 | 3.51 | 3.07 | 4.44 | 3.97 |
| | 100.00 | 100.00 | 100.00 | 100.00 | 100.00 |
| HEATING VALUE, | 13,081 | 13,724 | 13,029 | 12,400 | 12,500 |

TABLE I-continued

| COMPONENT WT. PERCENT | SLURRY FORMULATIONS POWDER RIVER BASIN, WYO. | MOFFAT COUNTY COLO. | ILLINOIS #6 BRUSHY CREEK | HANNA BASIN WYO. | CHUITNA ALASKA |
|---|---|---|---|---|---|
| BTU/LB (HHV) | | | | | |
| SULFUR CONTENT, WT. PERCENT | .16 | .09 | .71 | .43 | .06 |
| LBS SO2/ MMBTU FIRED | .25 | .13 | 1.08 | .71 | .10 |
| SPECIFIC GRAVITY @ 60 DEGREES F | 1.02 | .99 | 1.01 | .98 | 1.00 |
| ASH, WEIGHT PERCENT | 10.50 | 8.20 | 11.10 | 15.00 | 15.10 |

Liquid petroleum distillates which can be used include fractions from petroleum crudes or any artificially produced or naturally occurring hydrocarbon compound which is compatible with the coal-derived liquid organic hydrocarbon containing portion used as the slurry medium in accordance with the instant invention. These would include, without limitation, the aliphatic, cyclo-aliphatic and aromatic hydrocarbons, heterocyclics and phenols as well as multi-ring compounds, aliphatic-substituted aromatics and hydroxy-containing aliphatic-substituted aromatics. The aliphatics disclosed herein are intended to include both saturated and unsaturated compounds and their stereo-isomers. Particularly preferred are the lower chain alcohols including the mono-, di- and trihydroxy compounds. Preferably, the make-up hydrocarbons do not contain mercaptal, sulfate, sulfite, nitrate, nitrite or ammonia groups.

Preferably, chars that can be employed are discrete spherical particles which typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and pass 100 mesh, and preferably, 200 mesh. The chars which can be utilized in accordance with the instant invention have a high reactivity and surface area, providing excellent Btu to weight ratios. They are particulate in nature as distinguished from the larger, "structured" particles of the prior art. The char particles are sufficiently porous to facilitate beneficiation and combustion but the pore size is not so large as to require the use of excessive liquid for a given amount of solid.

The char may be efficaciously sized and beneficiated. It is important, in order to obtain the requisite liquid/-solid mixture having the desired rheological characteristics, that the solid component be discrete, particulate char. The spherical shape of the char particles allows adjacent particles to "roll over" one another, therefore improving slurry rheology and enhancing the solid loading characteristics. When utilizing agglomerating or "caking" coals, preferably the process parameters are regulated so as not to produce an agglomerated product as previously set forth herein.

The char may be beneficiated. When beneficiation is indicated because of the inorganics present, beneficiation may be utilized to clean either the coal or the char. The beneficiation can be performed by any device known in the art utilized to extract pollutants and other undesirable inorganics such as sulfur and ash. The char has a high degree of porosity which enables it to be readily beneficiated. Beneficiation may be accomplished, for example, by washing, jigging, extraction, flotation, chemical reaction, solvent extraction, oil agglomeration (for coal only) and/or electro-static separation. The latter three methods remove both ash and pyritic (inorganic) sulfur. When the solvent extraction or oil agglomeration methods are used, it is most advantageous to utilize, as the beneficiating agent, the liquid derived from the hydropyrolysis process. The exact method employed will depend largely on the coal utilized in forming the char, the conditions of hydropyrolysis, and the char size and porosity. The char material is ground to yield the substantially spherical, properly sized particulate coal char. Any conventional crushing and grinding means, wet or dry, may be employed. This would include ball grinders, roll grinders, rod mills, pebble mills and the like. Advantageously, the particles are sized and recycled to produce a desired distribution. The char particles are of sufficient fineness to pass a 100 mesh screen (Tyler Standard) and about 32% of the particles pass a 325 mesh screen. In accordance with the instant invention, char particles in the 100 mesh range or less are preferable. It will be realized that the particulate char of the instant invention having particle sizes in the above range is important to assure not only that the solid is high in reactivity, but also that the slurry is stable and can be pumped as a fluidic fuel directly into combustion systems.

The exact distribution of particle sizes is somewhat empirical in nature and depends upon the characteristics of the liquid organic fraction. The rheological characteristics of the slurry are interdependent upon the viscosity of the slurry liquid and the particle size distribution of the char.

The ground, beneficiated char can be sized by any apparatus known in the art for separating particles of a size on the order of 100 mesh or less. Economically, screens or sieves are utilized; however, cyclone separators or the like can also be employed. The spheroid shape of the primary particle provides spacing or voids between adjacent particles which can be filled by a distribution of second or third finer particle sizes to provide bimodal or trimodal packing. This modal packing technique allows addition of other solid fuel material such as coal to the slurry without affecting the very advantageous rheology characteristics of the particulate coal char/liquid organic fraction slurry of the instant invention. Additionally, this packing mode allows the compaction of substantially more fuel in a given volume of fuel mixture while still retaining good fluidity.

In accordance with another aspect of the instant invention, particular char produced from certain ranks of coal has pore sizes and absorption characteristics such as to require treating of the char prior to slurry of the particulate char with the liquid to reduce absorption by the char of the liquid phase. In accordance with the instant invention, prevention of excessive absorption of slurry liquid by the char is necessary to prevent instability of rheology characteristics. When absorption rates by the char are in excess of from about 10% to about 15%, pretreatment is very beneficial. In accordance with this pretreatment, the char is brought into intimate contact with an amount of the coating or "sealing" material effective to reduce the absorption of liquid by the char. The treatment is effected prior to the particulate char being slurried with the liquid. The sealants or coatings that are useful include organic and inorganic materials which will not produce pollutants upon combustion nor cause polymerization of the liquid slurry. Since surfactants and emulsifiers are used to enhance slurry stability, care must be taken that the coating or sealant is compatible with the stabilized composition. Sealants and coating materials which are particularly advantageous include parafins and waxes as well as the longer chain aliphatics, aromatics, polycyclic aromatics, aro-aliphatics and the like. Mixtures of various hydrocarbons, such as #6 fuel oil, are particularly desirable because of their ready availability and ease of application. Advantageously, the higher boiling liquid organic fractions from the hydropyrolysis of the coal are utilized. The sealant or coating can be applied to the char by spraying, electrostatic deposition or the like. In this manner, one can enhance the rheological stability of the slurry.

In accordance with another embodiment of the instant invention, coal and water, or more preferably the hydropyrolysis gases, are utilized to produce methanol and other lower chain alcohols, preferably in accordance with the method previously described. These alcohols are utilized as the liquid phase for the combustible fuel admixture to adjust liquid viscosity and enhance slurry rheology characteristics.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from HDP or natural gas. Advantageously, the alcohol constituent can be produced on site at the mine in conjunction with the HDP reaction.

Slurrying

The slurrying of the solid particles with the liquid can be accomplished by any well known mixing apparatus in which an organic liquid constituent and a particulate coal char can be mixed together in specific proportion and pumped to a storage tank. Advantageously, emulsifying techniques are used, such as high speed empellers and the like. The method of slurrying, and especially emulsifying, will vary the rheology characteristics of the slurry. Unlike coal/water slurries and coal/oil mixtures, the fuel of the instant invention is transportable by pipeline and therefore does not require slurrying equipment at the end-use facility. Thus, even small process heat systems can utilize the fuel of the instant invention efficiently and economically.

The important rheological aspect of the slurry in the instant application is that it is pumpable and stable. This is accomplished by matching the size of the solid char particle, the viscosity of the liquid phase and the stabilizer. Preferably, a small percentage by weight, for example from 1% to about 12%, of water is admixed into the slurry. This is especially preferable when surfactants which have hydrophyllic moieties are used. The slurry is preferably agitated or blended to produce a suspensoid which is stable under shear stress, such as pumping through a pipeline.

It will be realized that, in accordance with the instant invention, surfactants, suspension agents, organic constituents and the like may be added depending on the particular application. Certain well known surfactants and stabilizers may be added depending on the viscosity and non-settling characteristics desired. Examples of such substances which are useful in accordance with the instant invention include dry-milled corn flour, gelatinized corn flour, modified cornstarch, cornstarch, modified waxy maize, guar gum, modified guar, polyvinyl carboxylic acid salts, zanthum gum, hydroxyethyl cellulose, carboxymethyl cellulose, polyvinyl alcohol and polyacrylamide. As herein before mentioned, advantageously the admixture of the instant invention demonstrates high fluidity. Thus a high Btu per unit volume mixture is obtained with lower viscosities and higher fluidities. It is important for the skilled artisan to understand that certain of the well known stabilizers create adverse rheological characteristics. Although no fixed rule can be set, those substances which tend to form gelatinous mixtures tend to cause dilatant behavior.

As previously set forth, the sizing and packing of the solid is particularly important in obtaining a highly loaded, stable, transportable combustion fuel system. It has been found advantageous to have the solid material smaller than about 100 mesh (Tyler) and about 32% passing a mesh size in the range of 325 (Tyler). Preferably, the viscosity of the liquid organic fraction is in the range of from 17° API to about 20° API. This will of course depend on the loading and pumping characteristics desired, the stabilizers used, and whether coal and/or alcohol are present in the slurry in accordance with the instant invention. The degree API is very important in the end use application, i.e., the combustion system design. Those oil fired systems designed for "heavier" crudes will tolerate more viscious oils and higher loaded slurries.

Waste and Low Rank Coals

Lignite coals, ie., those coals containing in the range from about 35% to about 50% moisture and in the range of from about 35% to about 55% volatile matter (on a moisture-free basis), soft coals, peat and waste coals can be economically utilized to produce the transportable fuel containing particulate coal char by treating the coal to reduce moisture and/or pollutants in accordance with the instant invention.

In accordance with the invention, peat, lignites, waste coals, and lower rank coals are pretreated prior to pyrolysis to provide an economically efficient process and a compliance, high Btu product. In the case of peats, lignites and those coals containing a substantial amount of moisture, the material to be hydrodisproportionated is first subjected to mechanical and/or thermal treatment to reduce moisture. Advantageously, this is practiced in a continuous process whereby the process heat from the HDP reactor is used to dehydrate the feedstock material. In another aspect wherein the feedstock is high in ash, sulfur or other inorganic pollutants, the material is beneficiated either as a coal or as a char, as further set out herein.

Pollution Control

As previously stated, the fluidic fuel of the instant invention provides precombustion, elimination of pollution causing materials, specifically those whose produce $SO_x$ and $NO_x$ upon combustion. As previously set forth, the coal and/or the char may be beneficiated to remove pyritic sulfur. Organic fuel nitrogen and organic fuel sulfur are removed during the HDP reaction and further in the hydrotreating and fractionation unit 34.

In accordance with another aspect of the instant invention, methanol is added to the fluidic fuel as previously described in order to reduce the combustion (thermal) $NO_x$ by reducing the combustion temperature of the slurry. This, along with the uniformity of the fuel and the reactivity of char, greatly reduces the thermal $NO_x$ production. As previously described, thermal $NO_x$ is created by non-uniformity of coal which burns with hot spots.

In accordance with the invention, a method is provided of reducing the nitrogen produced during combustion of the fluidic fuel by admixing therewith methanol in an amount effective to reduce the flame temperature below the nitrous oxide producing temperature.

In accordance with the instant invention, a pulverized or powderized limestone is added directly to the slurry highly in excess of stoichiometric amounts to act as a reactant in the combustion of the slurry to reduce the $SO_x$ emissions from pyritic sulfur.

In accordance with another embodiment of the instant invention, coal and water, or more preferably the hydropyrolysis gases, are utilized to produce methanol and other lower chain alcohols which are utilized as the liquid phase for the combustible fuel admixture to adjust liquid viscosity and enhance slurry rheology characteristics. Water released from the coal during preheating can be sued as part of the water required in the synthesis, thus further preserving precious resources.

As used herein the term alcohol is employed to mean alcohols (mono-, di- and trihydroxy) which contain from 1 to about 4 carbon atoms. These include, for example, methanol, ethanol, propanol, butanol and the like. The alcohol may range from substantially pure methanol to various mixtures of alcohols as are produced by the catalyzed reaction of gases from hydropyrolysis or natural gas. Advantageously, the alcohol constituent can be produced on site at the mine in conjunction with the hydropyrolytic destructive distillation. The process heat can be supplied from the hydropyrolysis step.

The important rheological aspect of the slurry in the instant application is that it is pumpable and stable. This is accomplished by matching the size of the solid char particle, the viscosity of the liquid phase and the stabilizer. In accordance with the instant invention, a fluidic aqueous mixture is admixed into the char/hydrocarbon liquid slurry to enhance the rheological characteristics of the slurry. By "fluidic aqueous mixture" is meant a liquid material which contains at least a substantial portion of water. Advantageously, this material is derived from the moisture inherent in the coal as well as water produced by the hydrogenation during the hydropyrolysis and/or hydrotreating steps of oxygen inherent in the coal. When this aqueous mixture is used, it will contain a substantial portion of hydrocarbons from the pyrolysis. In accordance with this aspect, the aqueous mixture is preferably admixed with the char/hydrocarbon slurry after all the char and other solids (if any) have been added. This procedure minimizes the absorption of the aqueous material by the solid.

The amount of water present in the slurry can vary from a fraction of a percent to about 20%. Inherently, slurries of the instant invention may contain as much as 10% aqueous material as a result of water in the coal and/or water manufactured by hydrogeneration of oxygen. The amount of water present is that amount effective to enhance the rheology characteristics but preferably not an amount sufficient to substantially deleteriously affect the heating value of the slurry. When the slurry is fired directly, the aqueous mixture is fired along with the slurry. In the case where the slurry is to be deliquified and the solid material used alone as a fuel, the aqueous phase can subsequently be separated from the liquid.

In a greatly preferred embodiment, the aqueous mixture forms a discontinuous phase and, preferably, is emulsified with the pyrolysis hydrocarbon liquid. The aqueous phase is especially preferable when surfactants which have hydrophyllic moieties are used. The slurry is preferably agitated or blended to produce a suspensoid which is stable under shear stress, such as pumping through a pipeline.

The actual viscosity characteristics of even heavy oils and some tars can be greatly improved by the addition of water containing liquids. Some heavy materials such as tars which would otherwise be unusable are actually blendable in slurries with an aqueous phase and are particularly desirable as a carrying medium. In accordance with the instant invention, materials having boiling points in excess of about 300° F. can be utilized by whipping or stirring them with an aqueous mixture. Preferably, an emulsion is formed with the surfactants which is stable under shear force.

While the invention has been explained in relation to its preferred embodiment, it is understood that various modification thereof will become apparent to those skilled in the art upon reading the specifications and the invention is intended to cover such modifications as fall within the scope of the appended claims.

We claim:

1. A method of varying the rheology of a substantially completely combustible, non-polluting fluidic fuel system derived from coal comprising a portion of a particulate coal char dispersed in an amount of a liquid organic material effective to produce a transportable, liquid/solid mixture, wherein said liquid organic material is at least partially derived from the hydropyrolysis of coal, comprising the step of varying the viscosity of said liquid organic material by admixing with said admixture an amount of a fluidic aqueous mixture effective to enhance the rheological characteristics of the resultant liquid/solid mixture.

2. The method of claim 1 wherein said fluidic aqueous mixture forms a discontinuous phase.

3. The method of claim 1 wherein said fluidic aqueous mixture is water.

4. The method of claim 1 wherein said liquid organic material contains a lower chain alcohol of from 1 to about 4 carbon atoms.

5. The method of claim 4 wherein said lower chain alcohol is derived from the catalyzed reaction of coal derived gas or natural gas.

6. The method of claim 5 wherein said gas is at least partially derived from the hydrodisproportionation of coal.

7. The method of claim 1 wherein said liquid organic material is hydrotreated.

8. The method of claim 1 comprising the further step of varying the loading of said particulate coal char in said resultant liquid/solid admixture.

9. The method of claim 1 comprising the further step of varying the size distribution of the particulate coal char.

10. The method of claim 1 comprising the further step of processing said particulate coal char to effect bimodal or trimodal packing.

11. The method of claim 1 wherein said liquid/solid mixture further comprises a portion of a particulate carbonaceous material selected from the group consisting of raw coal, upgraded coal, dehydrated low rank coal, petroleum coke and mixtures thereof.

12. The method of claim 1 wherein said coal char obtained by pyrolysis of lignites, peats, low rank coals, waste coals and mixture thereof.

13. A method for varying the rheology of a substantially completely combustible fluidic fuel system which comprises a portion of a particulate coal char dispersed in an amount of a liquid organic material effective to produce a transportable, non-polluting liquid/solid mixture, wherein said liquid material is at least partially derived from the pyrolysis of coal, comprising the steps of (a) subjecting coal to hydrodisproportionation in the presence of a hydrogen-rich reducing atmosphere and to produce a coal char, an organic liquid and hydrocarbon containing gas;

(b) processing the coal char to produce a sized coal char;

(c) admixing said particulate coal char and said organic liquid to form said substantially completely combustible fluidic fuel system; and (d) admixing with said fluidic fuel system an amount of a fluidic aqueous mixture effective to enhance the rheological characteristics of the resultant admixture.

14. The method of claim 13 wherein said hydrogen-donating compound is selected from the group consisting of water and hydrogen.

15. The method of claim 13 further comprising the steps of removing from said organic liquid the aromatic constituents selected from the group consisting of benzene, toluene, xylene and naphtha prior to performing the first admixing step.

16. The method of claim 13 further comprising the steps of beneficiating said organic liquid prior to performing said first admixing step.

17. The method of claim 13 wherein hydrodisproportionation is carried out by subjecting coal to a preconditioning step prior to said hydrodisproportionation.

18. The method of claim 13 further comprising the step of coating said solid prior to performing said first admixing step with an amount of a sealant material effective to substantially diminish the absorption of said organic liquid and said fluidic aqueous mixture by said solid.

19. The method of claim 13 further comprising the step of admixing a particulate carbonaceous material selected from raw coal, upgraded coal, coke, petroleum coke and mixtures thereof with said coal char prior to said first admixing step.

20. The method of claim 13 wherein said organic liquid further comprises a portion of an alcohol having from about 1 to about 4 carbon atoms.

21. The method of claim 20 wherein said lower chain alcohol is derived from the catalyzed reaction in a once-through methanol process utilizing purified hydrodisproportionation hydrocarbon containing vapors.

22. The method of claim 13 further comprising the step of admixing said char with an amount of said organic liquid effective to prevent absorption of moisture and to enhance the combustion characteristics of said char for use as a solid fuel.

23. A fluidic fuel system comprising a portion of a particulate coal char dispersed in an amount of a mixture of a liquid organic material and a fluidic aqueous mixture effective to produce a transportable liquid/solid admixture wherein said liquid organic material is at least partially derived from the hydrodisproportionation of coal.

24. The system of claim 23 wherein said fluidic aqueous mixture comprises from about 0.1% to about 20% by weight of the liquid/solid admixture.

25. The system of claim 23 wherein said fluidic aqueous mixture comprises a discontinuous phase.

26. The system of claim 23 wherein said char is admixed with said organic liquid prior to admixing the solid/organic liquid admixture with said fluidic aqueous mixture.

27. The system of claim 23 wherein said fluidic aqueous mixture is at least partially derived from moisture inherent in the coal and hydrogenation during the pyrolysis process of oxygen inherent in the coal.

* * * * *